US005666837A

United States Patent [19]

Kajiwara et al.

[11] Patent Number: 5,666,837

[45] Date of Patent: Sep. 16, 1997

[54] ROLLING MILL AND METHOD OF USING THE SAME

[75] Inventors: Toshiyuki Kajiwara, Tokyo; Tokuji Sugiyama, Ibaraki-ken; Yoshio Takakura, Hitachi; Takao Sakanaka, Hitachi; Yasutsugu Yoshimura, Hitachi; Ken-ichi Yasuda, Katsuta; Shinichi Kaga, Hitachi, all of Japan

[73] Assignee: Hitachi Ltd., Tokyo, Japan

[21] Appl. No.: 332,756

[22] Filed: Nov. 1, 1994

Related U.S. Application Data

[63] Continuation-in-part of Ser. No. 224,017, Apr. 6, 1994, which is a continuation-in-part of Ser. No. 859,945, Mar. 30, 1992, abandoned.

[30] Foreign Application Priority Data

| | | | |
|---|---|---|---|
| Mar. 29, 1991 | [JP] | Japan | 3-066007 |
| Feb. 6, 1992 | [JP] | Japan | 4-020956 |
| Nov. 2, 1993 | [JP] | Japan | 5-274050 |

[51] Int. Cl.[6] ..... B21B 27/10

[52] U.S. Cl. ..... 72/14.4; 72/236; 72/241.4

[58] Field of Search ..... 72/199, 201, 236, 72/241.2, 241.4, 241.8, 14.4, 10.4, 365.2, 366.2

[56] References Cited

U.S. PATENT DOCUMENTS

| | | | |
|---|---|---|---|
| 1,954,289 | 4/1934 | Geeseman | 72/236 |
| 2,275,113 | 3/1942 | Simborg | 72/236 |
| 3,763,679 | 10/1973 | Lane et al. | 72/236 |
| 3,803,888 | 4/1974 | Hostetter et al. | 72/236 |

(List continued on next page.)

FOREIGN PATENT DOCUMENTS

| | | | |
|---|---|---|---|
| 0045583 | 3/1980 | Japan | 72/241.2 |
| 55-153605 | 11/1980 | Japan . | |
| 0157504 | 9/1983 | Japan | 72/241.2 |
| 0013504 | 1/1984 | Japan | 72/241.2 |

(List continued on next page.)

OTHER PUBLICATIONS

Kapnin, Vladimir Victorovich, "Development of Main Technological Parameters of Strip Rolling Process in Crossed Rolls of Four–High Stand", Ministry of Higher and Secondary Education, Moskosky Ordena Oktaybrskoy Revolutsii i Ordena Trudovogo Krasnogo Znameni Institut Staly i Splavov, pp. 16 –21 and translation, 1987.

(List continued on next page.)

*Primary Examiner*—Lowell A. Larson
*Assistant Examiner*—Thomas C. Schoeffler
*Attorney, Agent, or Firm*—Evenson McKeown Edwards & Lenahan, PLLC

[57] ABSTRACT

A work roll cross type rolling mill comprises a pair of work rolls and a pair of back-up rolls for backing up the work rolls. The back-up rolls are so arranged that their axes can be inclined within horizontal planes only to three or four specific angular positions. The work rolls are allowed to be inclined within horizontal planes with respect to the back-up rolls such that the axes of the work rolls cross the axes of the associated back-up rolls and cross each other. The nip between each the work roll and the associated back-up roll is lubricated so as to reduce axial thrust generated therebetween due to the crossing of the rolls. The cross angle between the work rolls is set and controlled during rolling operation only when the roll peripheral speed or the rolling speed is 50 m/min or higher. Advantages of work roll cross type rolling mill are fully extended to realize stable rolling without trouble so as to ensure high quality of the rolled product while achieving higher rate of operation of the mill with facilitated operation.

20 Claims, 15 Drawing Sheets

U.S. PATENT DOCUMENTS

| | | | |
|---|---|---|---|
| 4,132,342 | 1/1979 | Nitto et al. | 72/365.2 |
| 4,315,421 | 2/1982 | Wilson | 72/236 |
| 4,385,512 | 5/1983 | Matsumoto et al. | 72/199 |
| 4,478,063 | 10/1984 | Duke | 72/236 |
| 4,727,741 | 3/1988 | Ushifusa et al. | 72/241.2 |

FOREIGN PATENT DOCUMENTS

| | | | |
|---|---|---|---|
| 0040924 | 9/1985 | Japan | 72/241.2 |
| 5-50110 | 3/1993 | Japan . | |
| 5-277537 | 10/1993 | Japan . | |

OTHER PUBLICATIONS

V.N. Khloponin, V. V. Kapnin, "Investigation Into The Methods For Adjustment of A Strip Lateral Section in A Four–High Mill Stand", *Proceedings of Higher Educational Institutions, Ferrous Metallurgy,* No. 7, 1986, pp. 82–85 and translation.

V. V. Kapnin, V.N. Khloponin, "On Determining Contact Pressure inRolling With Crossed Working Rolls", p. 149 and translation, 1986.

ROLLING MILL AND METHOD OF USING THE SAME

CROSS REFERENCE TO RELATED APPLICATION

This application is a continuation-in-part application of application Ser. No. 08/224,017 filed on Apr. 6, 1994 which in turn is a continuation-in-part application of application Ser. No. 07/859,945 filed on Mar. 30, 1992, now abandoned.

BACKGROUND OF THE INVENTION

1. Field of the Invention

The present invention relates generally to rolling materials such as metal sheets and, more particularly, to a rolling mill having crossing work rolls and exhibiting excellent sheet crown control performance. The invention also is concerned with a rolling method employing the rolling mill and further to a method of using the rolling mill.

2. Description of the Related Art

One of the important criteria for evaluating the quality of rolled sheet is the sheet thickness distribution in the direction of breadth of the rolled sheet, i.e., sheet crown. The sheet crown varies according to rolling conditions or factors such as deflection of rolls due to rolling load, thermal crown of the rolls, wear of rolls, and so forth.

Hitherto, various measures have been considered to compensate for the influence of the above-mentioned factors on the sheet crown so as to make it possible to produce rolled sheets of desired profiles. One of such measures is to arrange rolls in a crossing manner so as to vary the vertical gap profile between work rolls or between each work roll and a cooperating back-up roll.

Known roll cross rolling methods are theoretically sorted into the following three types:

(1) Crossing arrangement is employed only for work rolls (Disclosed in, for example, M. D. Stone: Iron & Steel Engineering, August 1965)

(2) In the case of a 6-high mill, crossing arrangement is employed for back-up rolls or intermediate rolls which are in support of work rolls (Disclosed in, for example, M. D. Stone: Iron & Steel Engineering, August 1965)

(3) Roll pairs, each including a work roll and a back-up roll, are arranged to cross each other (Disclosed in, for example, Japanese Patent Publication No. 58-23161)

The method (1) has been tested and examined by Kono et al as reported in a literature "Spring Session of Plastic Work", Showa 56 (May, 1981), while the method (2) has been tested by A. R. E. Singer et al. as reported in a literature "Journal of the Iron and Steel Institute", December 1962. These methods, however, proved to be impractical due to too large thrust forces generated for given rolling load due to crossing between the work rolls and the back-up rolls. In fact, the method (1) showed a high level of thrust ranging from 8 to 13% the rolling load. Large thrust, say 6.5% the rolling load, was observed in the method (2).

In view of these problems, the method (3) has been proposed as roll cross rolling method which can vary the profile between the work rolls without generation of thrust between the work roll and the back-up roll. As stated before, according to this method, pairs of rolls, each pair including a work roll and a cooperating back-up roll, are arranged to cross each other. In this case, the thrust acting on the work roll is generated between this work roll and the sheet, so that the level of the thrust is about 6% at the greatest even in the region where the rolling reduction or draft is as high as 40%.

Such thrust can be borne by bearing structures which can be realized in spaces restricted by the upper and lower roll pairs each including the work roll and the back-up roll.

The rolling mill realizing the method (3) described above, generally referred to as a "pair cross mill" suffers from a disadvantage in that back-up rolls of heavy weights are to be moved. In addition, since the position of the back-up roll relative to the draft screw which bears the rolling load varies due to the movement of the back-up roll, a moment or couple of force is applied to a back-up roll chock, causing a tilt of the chock or uneven contact between the chock and the housing. In order to overcome this problem, a cross beam is provided between the back-up roll chock and the draft screw or between the back-up roll chock and the housing. Consequently, the whole construction is rendered complicated. The construction is further complicated due to the necessity of suitable anti-friction means such as plain bearings interposed between the cross beam and the draft screw of between the cross beam and the associated portion of the housing, in order that the work roll and the back-up roll are moved smoothly with reduced sliding resistance.

Japanese Unexamined Patent Publication No. 5-50110 discloses a rolling mill which has a simple construction but yet capable of performing crown control, thereby overcoming the above-described problem. This rolling mill is of the type in which only the work rolls are arranged to cross each other in the rolling method type (1) stated before. In this rolling mill, however, the thrust generated due to crossing between the work roll and the back-up roll is reduced to a level of 4 to 10% the rolling load, by lubricating effect offered by a liquid mixture (emulsion) of a base oil such as a mineral oil or a beef tallow and water containing 0 to 10% of oil.

In this rolling mill, the thrust is transmitted from the back-up roll to the work roll. The work roll also is subjected to thrust which is generated between the work roll and the sheet. This thrust acts in the counter direction to the thrust imparted by the back-up roll.

These two kinds of thrust cancel each other, so that the thrust applied to the work roll is actually 0 to 4%, 5% at the greatest, of the rolling load. It is therefore possible to bear against this thrust by a bearing or the like structure which is disposed in a limited space between the work roll and the back-up roll of the cooperating pair.

Thus, a rolling mill having work rolls crossing each other, which hitherto has been considered to impossible to practically realize, can be obtained by creating suitable conditions of lubrication between the work roll and the back-up roll.

It is to be pointed out, however, the inter-roll friction coefficient, which is one of the major parameters of the lubrication conditions, is largely ruled by the roll rolling conditions.

More specifically, the lubrication is performed by a film of the lubricating oil which is tapped into the nip between the rolls as a result of the roll rotation and which reduces the friction coefficient. The effect of reducing the friction coefficient is drastically increased when the roll rotation speed is increased and the friction coefficient is finally set to a range of from 0.04 to 0.12, although it varies according to the type of the lubricating oil used. When the roll rotation speed is low, however, the friction coefficient is large, say 0.15 or greater, as shown in FIGS. 2 and 3, allowing generation of large thrust.

When the cross angle of the work roll (angle to the direction perpendicular to the pass line) is increased, the thrust applied by the back-up roll to the work roll is saturated when the cross angle exceeds 0.5°, whereas the thrust imparted by the rolled sheet to the work roll is increased in proportion to the increase in the cross angle.

Therefore, the composite thrust acting on the work roll, as shown in FIG. 1, first appears to act in the direction of the thrust imparted by the back-up roll and this thrust exhibits a peak when the cross angle ranges between 0.5° and −1.0°. This thrust then starts to decrease and, when the cross angle exceeds 1.5°, the thrust acting in the counter direction becomes dominant. The thrust acting in the counter direction increases in proportion to the increase in the cross angle and finally exceeds the level which can be borne by the work roll. This fact has been confirmed also through experiment, as will be seen from FIG. 4.

The limit of the thrust which can be borne by the work roll depends on the thrust-bearing capacity of the bearing incorporated in the work roll chock.

SUMMARY OF THE INVENTION

The present invention has been accomplished through clarification of mutual relationships between the factors such as the rolling speed, loading load, cross angle and so forth, while taking into account the limit of thrust which can be loaded on the work roll.

An object of the present invention is to provide a rolling mill, as well as a rolling method and a method of using the rolling mill, capable of realizing stable rolling operation without trouble, by making full use of the advantages offered by roll cross mills.

Prior to a summary of the invention, a description will be given of the thrust coefficient in a roll cross mill employing crossing work rolls.

The inter-roll thrust coefficient (friction coefficient) $\mu t$, which is determined by dividing the thrust $F_t$ acting on each roll by the contact load P, is determined by the following two factors (I) and (II) within a Hertz flat region formed between the rolls due to elastic deformation caused by the application of the load:

(I) Relative slippage of rolls S (II) State of lubrication between rolls $\mu_o$ FIG. 5 shows a Hertz contact region formed between contacting rolls, while FIG. 6 is a view in the direction indicated by arrows A—A in FIG. 5. In each of FIGS. 5 and 6, the left side illustration depicts elastic deformation alone with a small cross angle, and the right side illustration depicts deformation with a strip and a large cross angle.

As will be seen from these Figures, the upper and lower rolls pressed to each other by the contact load P are elastically deformed to form a Hertz contact region therebetween. The upper and lower rolls contact each other at a point A. The axis of the upper roll is inclined at θ, while the lower roll axis is inclined at −θ, so that the point A would advance to points Au and Al, respectively. Actually, however, since the upper and lower rolls are pressed to each other, the upper and lower rollers rotate hand-in-hand so that the points Au and Al have been forcibly shifted to the point B when they emerge from the Hertz contact region. Consequently, the upper and lower rolls are urged in opposite directions towards the point B. These urging forces are the thrust $F_t$ acting on both rolls. The thrust coefficient (apparent friction coefficient) $\mu_t$ is obtained by dividing this force by the contact load P.

When the relative slippage S is small, the relative slip between the rolls is accommodated by the elastic deformation of both roll surfaces, so that the thrust coefficient $\mu t$ increases in proportion to the slippage S. When the slippage grows large, however, the slip cannot be accommodated by the elastic deformation alone, so that so-called slip takes place.

Namely, the portions of the surfaces of the upper and lower rolls which have been brought into contact at the point A should leave the Hertz contact region at the point B. However, since the distance between Au and Al is large, the elastic deformation accommodates only the fractions AuBu and AlBl, allowing so-called slips to occur over the lengths BuB and BlB.

The amounts BuB and BlB of the slips grow large as the distance between AuAl increases. A simple slip remains when AuBu and AlBl become sufficiently small as compared with BuB and BlB. In such a case, the thrust coefficient (apparent friction coefficient) $\mu_t$ coincides with the friction coefficient encountered by the relative slip between the two surfaces. The friction coefficient $\mu$ in this slip is determined by the aforesaid factor (II), i.e., the state of lubrication between the rolls.

It is to be noted here that the state of lubrication is determined not by the slippage due to crossing of the rolls but by the trapping of the lubricating oil caused by the rotation of the rolls. That is to say, the state of lubrication is equivalent to the lubrication between two cylinders which are rotating in contact with each other.

As stated before, the state of lubrication between the work roll and the back-up roll is ruled by the state of the lubricating oil film existing between these rolls and also by the contact load P acting between the two rolls. The state of the lubricating oil film is mainly determined by the viscosity $\eta$ of the lubricant and the peripheral speed $V_r$ of the roll In general, the friction coefficient is expressed as a function of $\eta V_r/P$, as shown in FIG. 7. When the value of $\eta V_r/P$ is large, a state called fluid lubrication has been attained so that a thin oil film is formed over the entire region of contact between both rolls. However, when the value $\eta V_r/P$ becomes small, the fluid lubrication condition can no more be maintained and so-called boundary lubrication condition starts to appear, allowing a local metal-to-metal contact due to breakage of the lubricating oil film, with the result that the friction coefficient $\mu$ is increased abnormally.

Thus, the thrust acting on the roll, under specific rolling conditions and conditions of rolling of the rolls on each other, is determined as combination of the forces which is expressed as the product of the friction coefficient $\mu$ and the contact load P.

In order to achieve the aforesaid object under these circumstances, the present invention in its one aspect provides a rolling mill comprising: a pair of work rolls; a pair of back-up rolls for backing up the work rolls, the back-up rolls being so arranged that their axes can rotate within horizontal planes only to three or four specific angular positions; means for allowing the work rolls to be inclined within horizontal planes with respect to the back-up rolls such that the axes of the work rolls cross the axes of the associated back-up rolls and cross each other; means for providing lubrication between each work roll and the associated back-up roll so as to reduce axial thrust generated therebetween due to the crossing of the rolls; and cross angle setting and controlling means for performing setting and control of the cross angle between the work rolls during rolling operation only when the roll peripheral speed or the rolling speed is 50 m/min or higher.

Preferably, the rolling mill further comprises interlocking means which prevents the cross angle setting and controlling means from performing the setting and control of the cross angle between the work rolls when the roll peripheral speed or the rolling speed is below 50 m/min.

The cross angle setting and controlling means may be arranged to set and control the angles of the axes of the work rolls in counter directions to each other with respect to a line which is perpendicular to the direction of rolling, within a range of from 0° to 2.5° in accordance with the rolling conditions.

Preferably, the rolling mill further comprises a work roll thrust plate associated with each the work roll so as to bear a thrust acting on the work roll, a hydraulic cylinder for supporting the work roll thrust plate, and work roll cross angle adjusting means which adjusts the cross angle between the work rolls so as to reduce the thrust when the level of the thrust supported by the hydraulic cylinder has become excessively large.

It is also preferred that a work roll bending force or a work roll balance force of 50 tons/chock or greater is applied to the work rolls.

The rolling mill preferably further comprises thrust measuring means for measuring the level of the thrust acting on the back-up roll and the work roll due to crossing of the back-up and work rolls, and rolling load difference compensating means for compensating, based on the thrust level measured by the thrust measuring means, for influence of the roll crossing on the difference in the rolling load appearing between the driving end and the operation end of the rolls.

The present invention in its another aspect provides a rolling method for rolling a material by a rolling mill of the type which includes: a pair of work rolls; a pair of back-up rolls for backing up the work rolls, the back-up rolls being so arranged that their axes can rotate within horizontal planes only to three or four specific angular positions; means for allowing the work rolls to be inclined within horizontal planes with respect to the back-up rolls such that the axes of the work rolls cross the axes of the associated back-up rolls and cross each other; and means for providing lubrication between each work roll and the associated back-up roll so as to reduce axial thrust generated therebetween due to the crossing of the rolls; the method comprising: conducting setting and control of the cross angle between the work rolls during rolling operation only when the roll peripheral speed or the rolling speed is 50 m/min or higher.

Preferably, the setting and control of the cross angle between the work rolls is prohibited when the roll peripheral speed or the rolling speed is below 50 m/min.

The setting and control of the angles of the axes of the work rolls may be performed in counter directions to each other with respect to a line which is perpendicular to the direction of rolling, within a range of from 0° to 2.5° in accordance with the rolling conditions.

Preferably, the rolling mill further includes a work roll thrust plate associated with each the work roll so as to bear a thrust acting on the work roll, a hydraulic cylinder for supporting the work roll thrust plate, the method comprising adjusting the cross angle between the work rolls so as to reduce the thrust when the level of the thrust supported by the hydraulic cylinder has become excessively large.

It is also preferred that a work roll bending force or a work roll balance force of 50 tons/chock is applied to the work rolls in the period between the clearance of the work rolls by the trailing end of a preceding rolled material and catching of the leading end of the next material to be rolled, thereby preventing slip between the work roll and the associated back-up roll due to deceleration of the rolls.

Preferably, the rolling method further comprises measuring the level of the thrust acting on the back-up roll and the work roll due to crossing of the back-up and work rolls, and effecting, based on the measured thrust level, compensation for influence of the roll crossing on the difference in the rolling load appearing between the driving end and the operation end of the rolls.

The present invention in its still another aspect provides a method of using a rolling mill of the type which includes: a pair of work rolls; a pair of back-up rolls for backing up the work rolls, the back-up rolls being so arranged that their axes can rotate within horizontal planes only to three or four specific angular positions; means for allowing the work rolls to be inclined within horizontal planes with respect to the back-up rolls such that the axes of the work rolls cross the axes of the associated back-up rolls and cross each other; and means for providing lubrication between each work roll and the associated back-up roll so as to reduce axial thrust generated therebetween due to the crossing of the rolls; wherein the rolling mill is used as a coarse rolling mill while the maximum allowable rolling load is set to 6000 tons, with the cross angle between the work rolls set to zero when the maximum allowable rolling load is exceeded. The rolling mill also may be used as a finish rolling mill while the maximum allowable rolling load set to 5000 tons, with the cross angle between the work rolls set to zero when the maximum allowable rolling load is exceeded.

The rolling mill also may be used as a thick-sheet rolling mill while setting the maximum allowable rolling load to 10000 tons, and setting the cross angle between the work rolls to zero when the maximum allowable rolling load is exceeded.

The rolling mill also may be used as a cold rolling mill while setting the maximum allowable rolling load to 3500 tons, and setting the cross angle between the work rolls to zero when the maximum allowable rolling load is exceeded.

By virtue of the features stated above, the present invention offers the following advantages.

The present invention determines such operating conditions for a combination of a work roll and a back-up roll which are operating under a rolling load or an idle load in lubricated condition that make it possible to maintain the thrust acting between both rolls to a level which is not greater than 10% of the rolling load or the idle load. In order to meet such conditions, the invention requires that the setting of the roll crossing angle and the control of the same during the rolling are effected within the range of the rolling speed or the roll rotation speed of 50 m/min or higher. Preferably, means are provided for prohibiting the roll crossing control for the work rolls when the rolling speed or the roll rotation speed is 50 m/min or less.

More specifically, when an emulsion formed by using a mineral oil or a beef tallow as the base oil and mixing it with water is used as the lubricant, the friction coefficient $\mu$ between the rolls becomes smaller as the roll rotation peripheral speed is increased beyond the speed employed in the experiment conducted using a cross mill, and is as small as about 0.1 or less when the peripheral speed is 50 m/min or higher. Consequently, the thrust generated can safely be borne by the back-up roll thrust bearing which is designed to withstand a maximum limit thrust set to a level of 10% the rolling load.

Preferably, the setting of the cross angle of the work rolls and control of the same during rolling operation are executed in accordance with the rolling conditions such that the work rolls are set in opposite directions within a range of from 0° to 2.5° with respect to the direction perpendicular to the direction of the rolling, so as to achieve a predetermined crowning of the rolled sheet. More preferably, the present invention employs a work roll thrust plate which bears against the thrust acting on the work roll, a hydraulic cylinder which is in support of the work roll thrust plate, and control means which controls the cross angle between the work rolls so as to reduce the thrust when the level of the thrust loaded on the hydraulic cylinder has become excessively large, thereby preventing the work rolls from being excessively loaded with thrust due to too large angle of crossing set between the work rolls, while enabling the rolling mill to operate at the maximum cross angle to fully extend its performance, thus realizing stable rolling without trouble to ensure high quality of the rolled product.

The thrust which acts on each work roll is composed of the following two components A and B:

(A) Force generated due to crossing between the work roll and the back-up roll (B) Force generated due to crossing between the work roll and the rolled sheet and acting in the direction counter to the force (A) above.

Representing the rolling load by P, the thrust coefficient (friction coefficient) between the work roll and the back-up roll by $\mu_b$, and the thrust coefficient between the work roll and the sheet by $\mu_s$, the thrust $F_b$ acting on the back-up roll by and the thrust $F_w$ acting on the work roll are given by the following equations (1) and (2), respectively:

$$F_b=\mu_b\times P \tag{1}$$

$$Fw=(\mu_b-\mu_s)\times P \tag{2}$$

The thrust coefficient $\mu_b$ is determined by the lubricating condition $\mu$ of the sliding contact between the work roll and the back-up roll and the cross angle $\theta$ (slippage S=tan $\theta$). For the same reason as that applied to the shifting of intermediate roll in 6-high mill, the thrust coefficient $\mu_b$ is approximated by the following formula:

$$\mu_b=\mu_o(1-0.000725/\tan\theta) \tag{3}$$

where, $\mu_o$ represents the friction coefficient as obtained under the full slipping condition at the contact region.

The friction coefficient $\mu_b$ is approximately equal to $\mu_o$ when $\theta$ is greater than 0.5 (S>0.0087).

On the other hand, $\mu_s$ is influenced also by shearing deformation of the material and is expressed by the following equation (4) when the angle meets the condition of $0<\theta<3°$.

$$\mu_s=k\times\tan\theta \tag{4}$$

The following equation (5) is derived from the foregoing equations (1) to (4):

$$Fw=[\mu_o\{1-0.000725/\tan\theta\}-k\times\tan\theta]\times P \tag{5}$$

Condition of |Fb|>|Fw| is derived from the equations (1) and (2). In general, the diameter of a back-up roll is more than twice as large the diameter of cooperating work roll, so that the maximum allowable thrust which can be sustained by the back-up roll is several times as large as that which can be borne by the work roll.

Consequently, the roll cross angle is limited by the thrust which can be borne by the work roll.

FIG. 1 shows the relationship between the cross angle and the thrust coefficient. More specifically, in FIG. 1, a solid-line curve shows the relationship between the cross angle and the thrust coefficient ($F_w$/P) corresponding to the thrust imposed on the work roll. When the thrust force to be applied to the work roll is limited to be from 3 to 4% the rolling load due to restriction in the load capacity of the bearing, the maximum cross angle is set to be from 2.5° to 3°.

This shows that the operation can be performed stably without trouble when the operation is conducted without causing the roll cross angle to exceed the maximum allowable value of 2.5°.

It is also preferred that the lubrication between the work roll and the back-up roll is conducted while a work roll bending force or a work roll balance force of at least 50 tons/chock is applied to the work roll, so as to eliminate any slip between the rolls during acceleration and deceleration, thereby ensuring stable operation without trouble.

To explain in more detail, lubrication between the rolls reduces the coefficient of friction between the rolls, tending to allow occurrence of slip between these rolls. More specifically, reduction in the friction coefficient $\mu$ down to 0.04 or below on the one hand causes a reduction in the level of the thrust but on the other hand increases the tendency of occurrence of slip between the work roll and the back-up roll, particularly when the rolls are decelerated to perform low-speed rolling in the transient period after the trailing end of a preceding sheet has left the rolling mill and before a leading end of the subsequent sheet is taken up by the down coiler. In order to avoid occurrence of the slip, during deceleration of the rolling mill, a roll bending force and/or a roll balance force is applied to act between the work roll and the back-up roll, so as to increase the proportion of the force transmitted between the work roll and the back-up roll.

The torque T exerted by the back-up roll is expressed by the following equation (6):

$$T=I_b\frac{\frac{2\pi}{60}(N_1-N_2)}{Z} \tag{6}$$

where, Ib represents the moment of inertia of the rotating back-up roll (kgms$^2$), N represents the speed of rotation of the back-up roll (rpm), V represents the peripheral speed of the back-up roll (m/min), $D_b$ represents the diameter of the back-up roll and Z represents the deceleration time (sec).

The equation (6) can be transformed into the following equation (7):

$$T=\frac{2\pi}{60}I_b\frac{N_1-N_2}{Z} \tag{7}$$

Tangential force Fs exerted by the back-up roll is given by the following equation (8):

$$F_s=\frac{T}{\frac{D_b}{2}} \tag{8}$$

The equation (8) is transformed into the following equation (9):

$$F_s=\frac{4}{60}\pi\times\frac{I_b}{D_b}\times\frac{N_1-N_2}{Z} \tag{9}$$

wherein N is given by:

$$N=\frac{V}{\pi D_b} \tag{10}$$

Therefore, the equation (9) is transformed into the following equation (11):

$$F_s=\frac{4}{60}\times\frac{I_b\times(V_1-V_2)}{D_b^2\times Z} \tag{11}$$

Representing the coefficient of friction between the rolls by $\mu$, the condition of the following equation (12) must be met in order that the slip between the rolls is avoided:

$$\mu F_{RBF}>F_s \tag{12}$$

where $F_{RBF}$ is work roll bending or balance force.

The condition of the following equation (13) is derived from the equation (12):

$$F_{RBF} > \frac{F_s}{\mu} = \frac{4}{60} \times \frac{I_b}{\mu D_b^2} \times \frac{(V_1 - V_2)}{Z} \quad (13)$$

It is assumed here that the friction coefficient μ is 0.04, the back-up roll diameter Db is 1.5 (m) and that the moment of inertia $I_b$ is 1020 (kgmsec$^2$). It is also assumed that the deceleration time Z is 5 (sec) and that the amount of change in the peripheral speed ($V_1$–$V_2$) due to deceleration is 300 m/min. Thus, the deceleration is expressed as follows:

$$(V_1 - V_2)/Z = 300/5 = 60 \ \{(\text{m/min})/\text{sec}\}$$

Consequently, the work roll bending force or work roll balance force $F_{RBF}$ should meet the following condition:

$$F_{RBF} > \frac{4}{60} \times \frac{1020}{0.04 \times 1.5^2} \times 60 = 45333 \text{ (kg)} \approx 45 \text{ (ton)}$$

It is therefore understood that the rolling operation can be done stably without allowing any slip to occur between the rolls, provided that a roll bending force or a roll balance force of 50 tons/chock is applied.

Crossing of the rolls generates a moment within a vertical plane containing the roll axis. This moment acts to balance the difference in the rolling load between the operation end and the driving end of the roll. At the same time, difference in the rolling load between the operation end and the driving end is caused by other reasons such as winding of the sheet or wedging. Thus, there is a risk of mis-operation due to the fact that the difference in the rolling load balancing the above-mentioned moment is wrongly regarded as being a difference caused by winding or wedging of the rolled sheet. In order to ensure that the rolling can be done stably while avoiding such a mis-operation, it is preferred that thrust measuring means are provided to measure at least one of the thrust acting on the back-up roll and the thrust acting on the work roll due to the crossing of the rolls, so that the difference in the rolling load between the driving and operation ends of the roll is corrected in accordance with the result of measurement of the thrust, thereby eliminating any influence of the roll crossing appearing in the difference in the rolling load between the driving end and the operation end of the roll.

More specifically, the thrust generated by the crossing of the roll and acting on each roll generates a moment or a couple of force within a vertical plane containing the roll axis. In order that this moment is balanced, reaction forces are exerted by the housing parts adjacent to the operation end and the driving end of the roll, and these reaction forces are detected as the difference in the load.

In general, in operation of rolling mills, any difference in the load is regarded as being a sign of winding of the sheet or generation of a wedge and, therefore, measures are taken to cancel this difference by adjusting the levels at the operation end and the driving end of the roll. The difference in the load caused by the crossing of the rolls, however, is not indicative of any winding or wedging. Therefore, control of levels of the roll at the driving and operating ends upon a mere detection of the difference in the load, in the absence of winding or wedging, may wrongly lead to generation of winding or wedging of the sheet.

The present invention therefore also provides means for compensating for the difference in the rolling load caused by the crossing of the rolls, so that the cross mill can be stably operated under a conventional control, without being affected by the moment which is generated as a result of crossing of the rolls.

Setting various parameters as illustrated in FIG. 11, the difference ΔP in the load caused as a result of the crossing of the rolls is determined by the following equation (14):

$$\Delta P = \frac{2}{L_H}\left\{\frac{D_b}{2} + D_w - \mu_{kb}L_{kb}\right\}F_b + \frac{2}{L_H}\left\{-\frac{D_w}{2} - \mu_{kw}L_{kw}\right\}F_w \quad (14)$$

In FIG. 11, numeral 1 denotes a keeper plate, $\mu_b$ indicates the coefficient of friction between the work roll and the back-up roll, $D_w$ indicates the diameter of the work roll, $D_b$ indicates the diameter of the back-up roll, $\mu_{kb}$ indicates the coefficient of friction between the keeper plate and a back-up roll chock, $L_{kb}$ indicates the distance between the center of the rolling mill and the keeper plate, $\mu_{kw}$ indicates the coefficient of friction between the keeper plate and work roll chock, $\mu_s$ indicates the coefficient of friction between the rolled material and the work roll, P indicates the rolling load and $L_H$ indicates the distance between the centers of the back-up roll chocks.

FIG. 12 shows the result of a comparison between test data and results of calculation. It will be seen from FIG. 12 that the test data well conforms with the results of calculation.

This means that the rolling operation can be performed stably without being affected by the difference in the load caused by the generation of the moment, when the difference in the load level between the operating end and the driving end of the roll is compensated for in accordance with the equation (14).

The present invention also provides a method of using a rolling mill in which the maximum rolling load in each roll stand is set such that the thrust generated by the crossing of rolls and acting on the back-up roll, under lubrication and with a support by the bearing capacity of bearing accommodatable in a thrust bearing installation space determined by the roll diameter, is 10% of the maximum rolling load.

More specifically, according to the present invention, there is also provided a method of using a rolling mill of the type which includes: a pair of work rolls; a pair of back-up rolls for backing up the work rolls, the back-up rolls being so arranged that their axes can rotate within horizontal planes only to three or four specific angular positions; means for allowing the work rolls to be inclined within horizontal planes with respect to the back-up rolls such that the axes of the work rolls cross the axes of the associated back-up rolls and cross each other; and means for providing lubrication between each work roll and the associated back-up roll so as to reduce axial thrust generated therebetween due to the crossing of the rolls; wherein the rolling mill is used as a coarse rolling mill while the maximum allowable rolling load is set to 6000 tons, with the cross angle between the work rolls set to zero when the maximum allowable rolling load is exceeded. The rolling mill also may be used as a finish rolling mill while the maximum allowable rolling load is set to 5000 tons, with the cross angle between the work rolls set to zero when the maximum allowable rolling load is exceeded.

The rolling mill also may be used as a thick-sheet rolling mill while setting the maximum allowable rolling load to 10000 tons, and setting the cross angle between the work rolls to zero when the maximum allowable rolling load is exceeded.

The rolling mill also may be used as a cold rolling mill while setting the maximum allowable rolling load to 3500 tons, and setting the cross angle between the work rolls to zero when the maximum allowable rolling load is exceeded.

Thus, the present invention realizes trouble-free rolling by suitably setting the maximum allowable rolling load to a level which is allowed by the thrust bearing capacity which in turn is limited by the roll diameter.

In general, a relationship as shown in FIG. 8 is observed between back-up roll diameter and the rolling load, in rolling mills for thick-sheet rolling, hot coarse rolling, hot finish rolling and cold rolling. The ability to bear the thrust depends on the load capacity of the thrust bearing disposed on an end of the roll. Usually, the outside diameter of the thrust bearing is limited to be about ½ the roll outside diameter due to the construction of the bearing. Consequently, the maximum load capacity (thrust-based dynamic rated load) is limited as shown in FIG. 9.

Consequently, the maximum allowable rolling load is determined as shown in FIG. 10, by the load capacity of the bearing and by the thrust coefficient which is based on the thrust given by the back-up roll and which ranges between 0.045 and 0.07.

This level of rolling load is greater than load capacity of a radial bearing so that it does not cause any practical problem. However, any tendency to excessively load the thrust bearing of the back-up roll can be suppressed so that the rolling operation is rendered further stable, when the control is conducted to maintain the rolling load within a practically applicable range which is determined suitably.

For instance, when the back-up roll diameter is 2000 mm, the maximum outside diameter of the thrust bearing allowed by the bearing construction is about 1000 mm or so, as the thrust bearing diameter is about half the roll diameter at the greatest as stated before. Referring to FIG. 9, the maximum allowable load of the thrust bearing is determined to be 600 tons when the thrust bearing outside diameter is 1000 mm. Therefore, assuming that the thrust coefficient $F_t/P$ based on the thrust imparted by the back-up roll is 0.07, the maximum rolling load allowed by the thrust bearing capacity is determined to be 600/0.07=8571 tons.

In FIG. 10, a broken-line curve indicates the ordinary rolling load which is shown in FIG. 8.

It will be seen that the ordinary rolling load is smaller than the maximum rolling load allowed by the thrust bearing capacity, so that the thrust can be borne safely by the thrust bearing.

As will be understood from the foregoing description, according to the present invention, it is possible to create such a condition that the thrust coefficient between the rolls is not greater than 0.1, preferably from 0.04 to 0.07, when a rolling load or idle load is acting between the rolls while a nip between these rolls is lubricated. Thus, the present invention provides a rolling mill, as well as a rolling method using the rolling mill, capable of preventing any serious trouble from occurring instantaneously or in quite a short time.

The present invention pertains to the fundamentals of the operation of a rolling mill having crossing work rolls. The invention prevents any excessive thrust from being applied to the work roll, thus ensuring stable operation and high rate of operation. Furthermore, the present invention eliminates any slip between the work roll and the associated back-up roll so as to suppress damaging of the rolls and to improve rate of operation of the rolls, while enhancing the yield per roll. Furthermore, according to the invention, the difference in the rolling load caused by the crossing of the roll is determined based on the thrust acting on the back-up roll and this difference is subtracted from the measured difference in the load level between the operating and driving ends of the roll, so that only the load level difference component caused by winding or wedging of the sheet which is being rolled appears in the detected difference in the rolling load level between the driving and operating ends of the roll. Consequently, the operator can adequately control the operation without being confused by the difference in the rolling load level caused by the crossing of the work rolls. It is therefore possible to stably perform the rolling operation without causing excessive rolling reduction or generation of wedge.

The present invention also provided general criterion for the maximum rolling load in phase rolling mill, finish rolling mill, cold rolling mill or a thick sheet rolling mill which employs crossing work rolls. This makes it possible to select work roll cross mill based on the actually required rolling load, thus eliminating various troubles which otherwise may be caused in the operation. Thus, the present invention provides a method of using a rolling mill which enables selection of a mill without any substantial error.

According to the present invention, it is thus possible to provide a rolling mill, as well as a rolling method using the rolling mill and a method of using the same, which enables the advantages of the work roll cross mill to be fully enjoyed, while ensuring stable rolling, as well a good quality of the rolled product, thus improving rate of operation of the rolling mill with facilitated operation.

DESCRIPTION OF THE PREFERRED EMBODIMENTS

The invention will now be fully described with reference to the drawings which show preferred embodiments.

Figure 13:
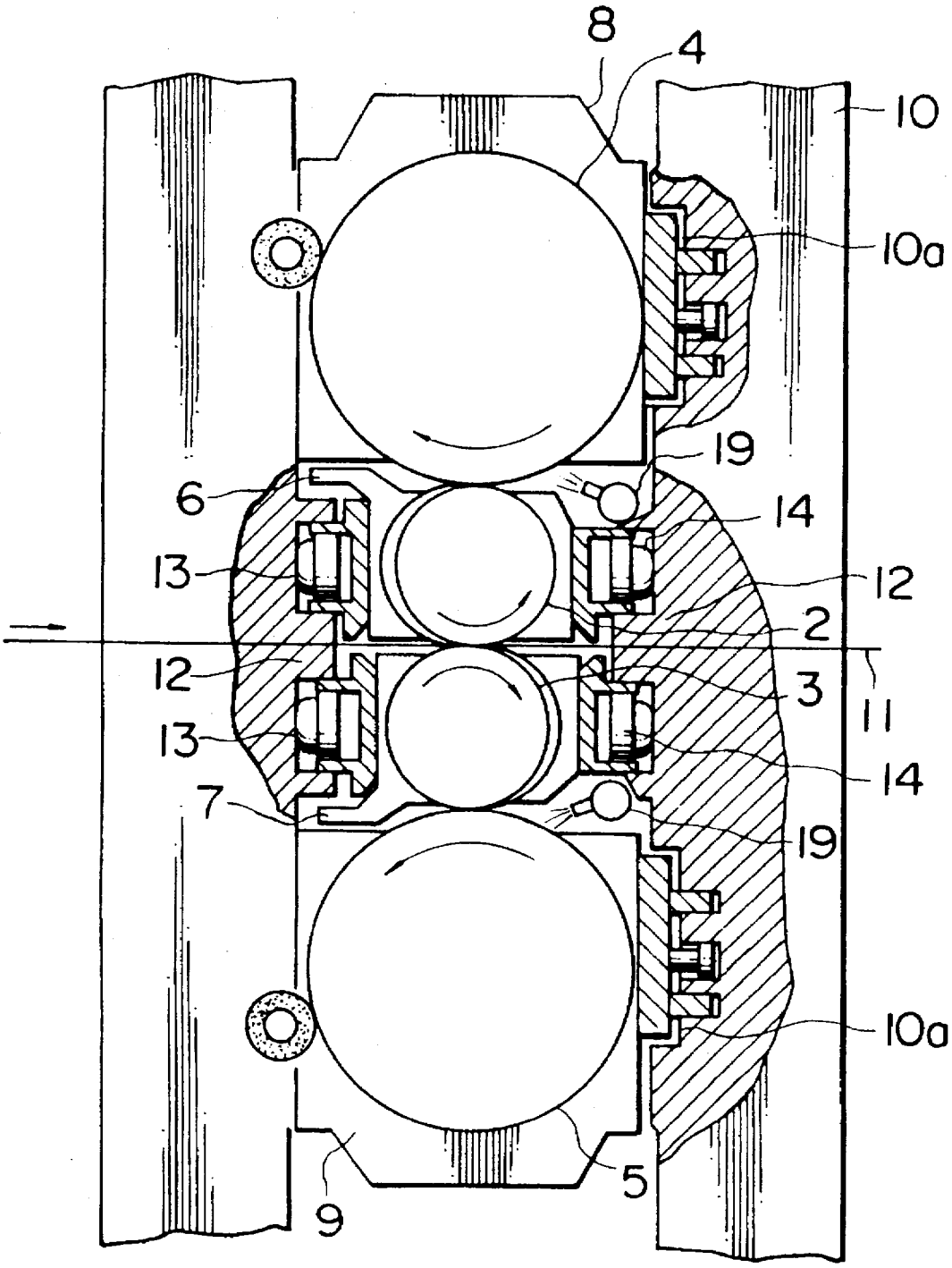
FIG. 13 is an end view of a 4-high mill with crossing work rolls as an embodiment of the present invention, as viewed in the direction of the roll axes.
Figure 14:
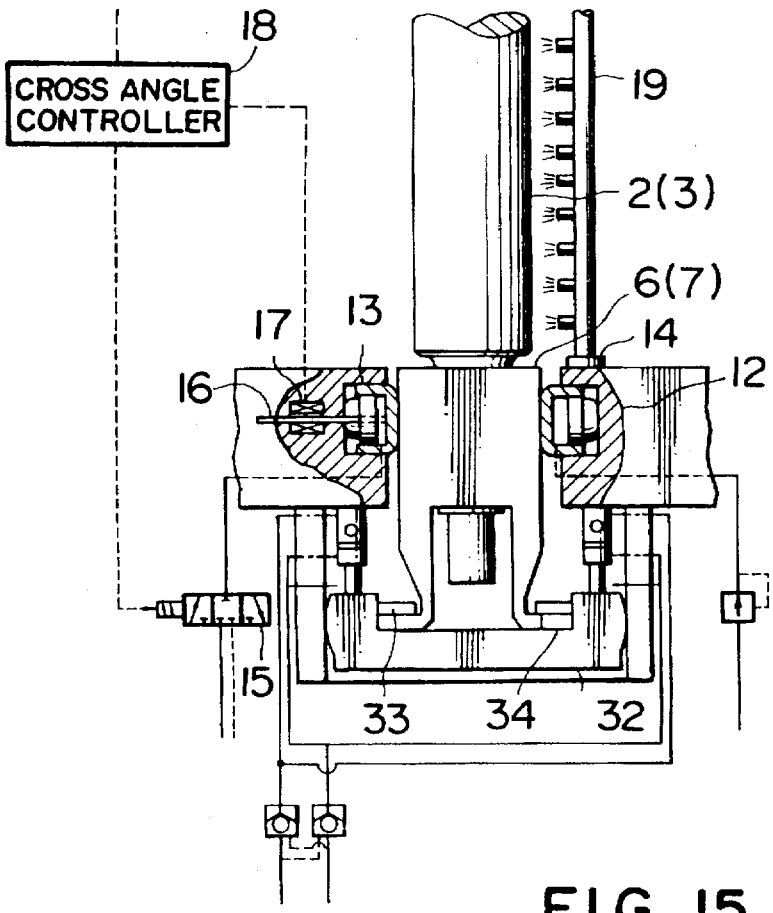
FIG. 14 is an illustration of an axial work roll shifting device used in the 4-high mill shown in FIG. 13.

FIG. 13 illustrates a cross-type 4-high mill as an embodiment of the rolling mill of the present invention. In this embodiment, only work rolls are arranged to cross each other. FIG. 14 illustrates a roll cross driving system of the rolling mill shown in FIG. 13.

Referring to FIGS. 13 and 14, the 4-high mill has upper and lower work rolls 2 and 3 which are arranged to cross each other, and upper and lower back-up rolls 4 and 5 which back-up these work rolls 2 and 3, respectively. The upper and lower work rolls 2 and 3 are rotatably supported at their both ends by work roll chocks 6 and 7 arranged at both axial ends of these rolls 2, 3.

Similarly, upper and lower back-up rolls 4 and 5 are rotatably supported at their both ends by back-up roll chocks 8 and 9 arranged at both axial ends of these rolls 4, 5.

These work roll chocks 6 and 7, as well as the back-up roll chocks 8 and 9, are disposed to confront window faces 10*a* of a pair of vertical stands 10 which are spaced in the direction of axes of the rolls. The arrangement is such that the rolling load is applied to the rolls by draft jacks (not shown) provided on upper or lower parts of the stands 10, thereby rolling a material 11 which is passed through the nip between the work rolls.

The arrangement is such that the axes of the upper and lower work rolls 2 and 3 are capable of being inclined within horizontal planes with respect to the axes of the upper and lower back-up rolls 4 and 5, while enabling the axes of the upper and lower work rolls to alternately cross, so that the work rolls 2, 3 alone are made to cross each other. To this end, hydraulic jacks 13 and 14 are provided on project blocks 12 which project from the stands 10 facing both side faces of the work roll chocks 6, 7 which are arranged on both axial ends of the upper and lower work rolls 2 and 3. By suitably operating both these hydraulic jacks 13 and 14, in is possible to dispose the upper and lower work rolls 2 and 3 to cross each other.

The hydraulic jacks 13 and 14 are adapted to be supplied with pressurized hydraulic oil through a change-over valve 15. The displacements of hydraulic rams of the hydraulic jacks 13, 14 are detected by sensors 17 which sense the amounts of movements of rods affixed to the hydraulic rams. The above-mentioned change-over valve 15 is controlled and operated by a work roll cross angle control device 18 in accordance with signals corresponding to the rolling conditions, so that the hydraulic jacks 13, 14 are activated to provide a desired angle of crossing between the upper and lower work rolls, under a feedback control which is effected in accordance with feedback signals derived from the sensors 17.

Lubricant supply nozzles 19 are arranged to supply a lubricating oil into the nip between the upper work roll 2 and the upper back-up roll 4 and into the nip between the lower work roll 3 and the lower back-up roll 5. The illustrated arrangements of the lubricating oil supply nozzles 19 are only illustrative and may be determined suitably provided that they can provide effective lubrication to the roll nips.

Figure 15:
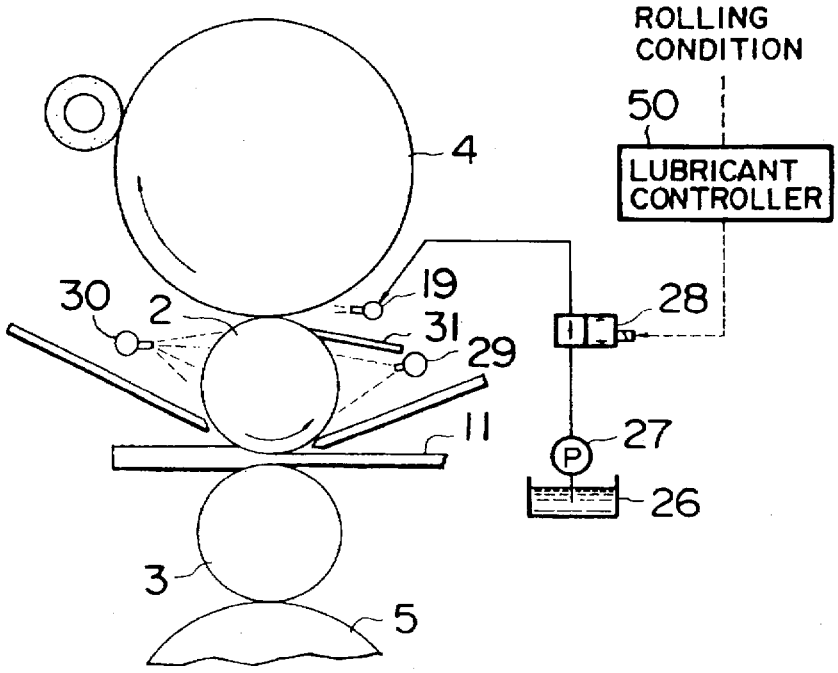
FIG. 15 is an illustration of the state of roll lubrication and supply of coolant to the 4-high mill shown in FIG. 13.

A system for supplying the lubricating oil from the nozzles 19 includes, as shown in FIG. 15, a tank 26, and a pump 27 which sucks the oil from the tank 26 and supplies the same to the lubricating oil supply nozzles 19 through a change-over valve 28. Thus, pressurized lubricating oil is sprayed into the nips between the upper and lower work rolls 2, 3 and the cooperating back-up rolls 4, 5.

The supply of the lubricating oil has to be suspended when the trailing end of a sheet has cleared the work rolls 2,3 or when a sheet is made to pass through the work rolls without rolling. Therefore, a lubricant controller 50, upon receipt of a signal indicative of a rolling state such as the leaving of the trailing end of a sheet or free passage of a sheet, operates to actuate the change-over valve 28 so as to stop the spray of the lubricating oil from the nozzles 19.

In FIG. 15, reference numerals 29 and 30 denote roll cooling nozzles for cooling the work rolls 2, 3 and the back-up rolls 4, 5. A scraper 31 serves to prevent the lubricant from being washed away by a coolant water which is supplied at large rates from the roll cooling nozzles 29 and 30.

A description will now be given of the lubricant used for the lubrication between both rolls.

The following conditions have to be met in order to realize a rolling mill of having the above-described construction in which the crossing roll arrangement is adopted only for the work rolls.

(i) Regarding catching of the rolled material into the nip between work rolls:

The lubricating performance of the lubricating oil is drastically impaired when the temperature is elevated. Namely, the lubricating oil which has lubricated the nip between the rolls is spread over the work roll surfaces so as to reach the sheet inlet portion where the sheet is caught into the nip between the work rolls, thus causing impediment to the catching of the sheet. The lubricant, however, contacts the rolled material the temperature of which is as high as 700° C. or higher. It is therefore desirable to use a lubricant which loses its lubricating nature when heated to high temperature.

(ii) Regarding inter-roll friction coefficient:

The friction coefficient has to be 0.1 or less, due to restriction posed by the load capacity of the thrust bearing for bearing thrust acting on the work roll. Usually, the load capacity of the work roll thrust bearing is 5% of the rolling load at the greatest. In a rolling mill in which the work rolls cross each other, the thrust force applied to the work rolls is the difference between the force imparted by the back-up roll (corresponds to the above-mentioned friction coefficient 0.1) and the force imparted by the rolled material (5% of the rolling load at the maximum). Therefore, when the coefficient of friction between the rolls is 0.1 or less, the thrust load applied to the work roll is 5% or less of the rolling load.

The friction coefficient must not be less than 0.04 in order to avoid any slip of the back-up roll which may occur during acceleration after the catching of the material to be rolled and during deceleration after the leaving of the trailing end of the preceding material. The back-up roll is frictionally driven by the work roll and exhibits a large inertia. Therefore, if the coefficient of friction between the work roll and the back-up roll is small, the back-up roll is allowed to slip so as to cause a local wear of the surface of the back-up roll. Usually, a comparatively large force corresponding to the balance force of the work roll is applied to the back-up roll. In spite of the application of such a large force, the friction coefficient between the rolls has to be at least 0.04, in order to transmit a torque which is the sum of a torque corresponding to the resistance produced by a seal of the back-up roll bearing (this resistance corresponds to about 0.01 in terms of the friction coefficient), inertia torque required for accelerating the roll (this torque corresponds to 0.02 to 0.03 in terms of the friction coefficient) and so forth.

(iii) Regarding vibration caused by slip caused between the rolls due to crossing of the rolls.

In order to prevent vibration, it is preferred that the coefficient of the friction between the rolls is small. This vibration is caused by axial elastic deformation of the roll surfaces due to stick-slip and is not produced when the friction coefficient is small, usually when the friction coefficient is 0.1 or less.

The strength of the oil film formed by the lubricant is preferably large, in order to prevent the vibration. The load acting between the rolls is very large, so that the lubrication between the rolls is inevitably conducted under boundary lubricating condition, tending to allow breakage of the oil film and consequent stick-slip. In order to prevent generation of vibration, therefore, it is preferred that the oil film has a sufficiently large strength.

(iv) Axial uniformity of lubrication of the roll surface

The lubricant should have a viscosity of 80 Cst or less at normal temperature (40° C.). Namely, a lower viscosity provides a greater fluidity of the lubricant, reducing any tendency of clog of the lubricating system by the lubricant, while ensuring uniform spreading of the lubricant over the surface of the roll and a consequent uniform lubrication over the entire axial length of the roll.

(v) Regarding treatment of lubricant

It is necessary that the lubricant has good separability from the coolant when the lubricant is mixed with coolant. The lubricant after lubrication is inevitably mixed with the coolant which is supplied at a large rate to cool the work roll. The coolant is continuously circulated and momentarily substituted with fresh water, and the water after the cooling is discharged to the outside of the factory. It is therefore very important that the lubricant is easily separable from the coolant. Inferior separability requires a huge cost for the treatment of the disposed water or a large scale of disposal system is required.

In order that the above-described conditions (i) to (v) are met, it is necessary that the lubricant used in the rolling mill of the present invention satisfies the following requirements (1) to (6)

(1) The coefficient of friction between the work roll and the back-up roll should range from 0.04 to 0.1.
(2) The viscosity should be 80 Cst or less at 40° C.
(3) The lubricant should contain, as the base oil, a mineral oil and not less than 5% of synthetic ester.
(4) The maximum content of any surfactant (emulsifier) should be 1% or less.
(5) The lubricant should contain 0.03 to 0.5% of aliphatic acid as an oiliness improver.
(6) The lubricant should contain not less than 0.1% of extreme-pressure additive.

The lubricant may be supplied as it is or atomized by compressed air or may be used in the form of an aqueous solution of, for example, 3% density. The lubricating effects are almost the same regardless of the method of the supply.

Figure 16:
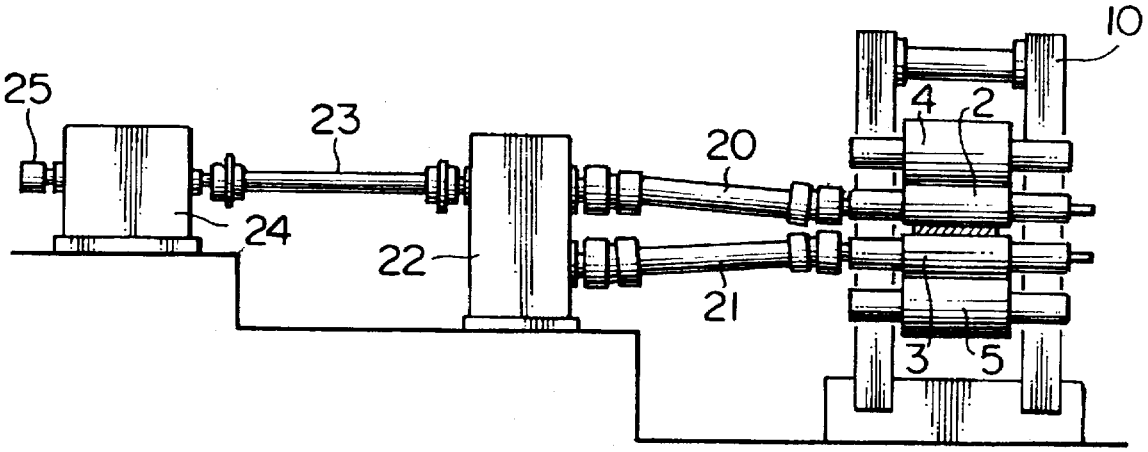
FIG. 16 is a schematic illustration of a 4-high mill shown in FIG. 13 inclusive of the driving system.

FIG. 16 schematically shows the whole workroll cross-type 4-high mill embodying the present invention described before in connection with FIGS. 13 and 14, inclusive of a driving system for driving the rolling mill. The work rolls are connected at their one ends to a transmission in a pinion stand 22 through respective spindles 20, 21. The transmission is coupled to a motor 24 through a motor shaft 23. The speed of rotation of the upper and lower work rolls 2 and 3 is detected by a tachometer 25 which is affixed to the end of the shaft of the drive motor 24. The change-over valve 15 is interlocked by the work roll cross angle controller 18 such that the hydraulic jacks 13, 14 shown in FIG. 14 are never activated unless the rolls are accelerated to 50 m/min or higher in terms of the peripheral speed.

Although not shown, a flowmeter and a pressure gauge are provided to monitor the pressure and the flow rate of the lubricant so as to ensure that the lubricant is supplied at appropriate levels of pressure and flow rate. The change-over valve 15 also is interlocked by the work roll cross angle controller 18 such that the hydraulic jacks are not operated when the pressure and/or the flow rate is insufficient to operate these hydraulic jacks.

The maximum value Stmax of the stroke $S_t$ of each hydraulic jack 13, 14 is determined as follows as the product of the distance L between the roll bearings and the maximum cross angle α.

$$Stmax = L \times \tan \alpha \quad (15)$$

Figure 1:
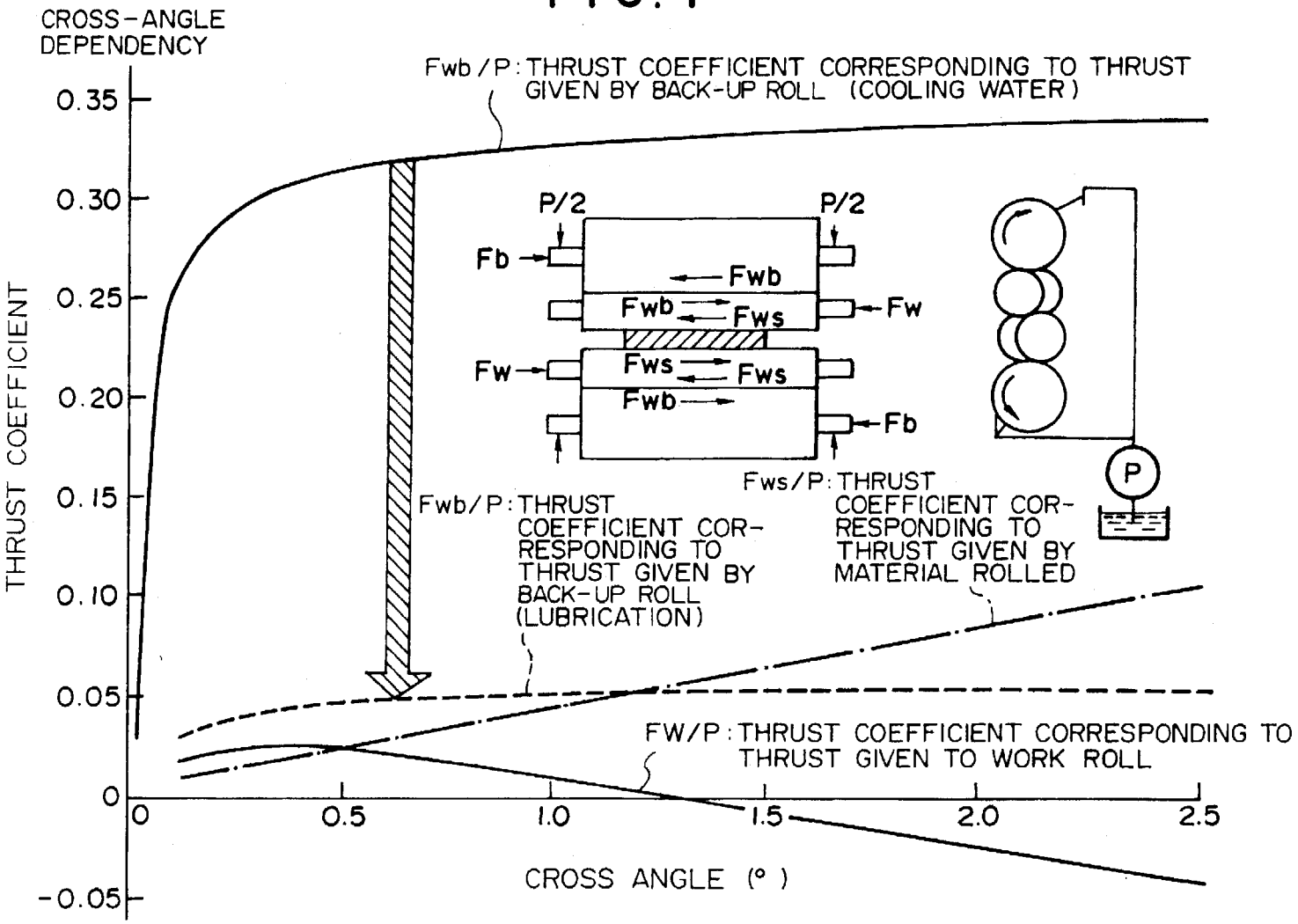
FIG. 1 is a diagram showing the relationship between cross angle and a thrust coefficient.
Figure 2:
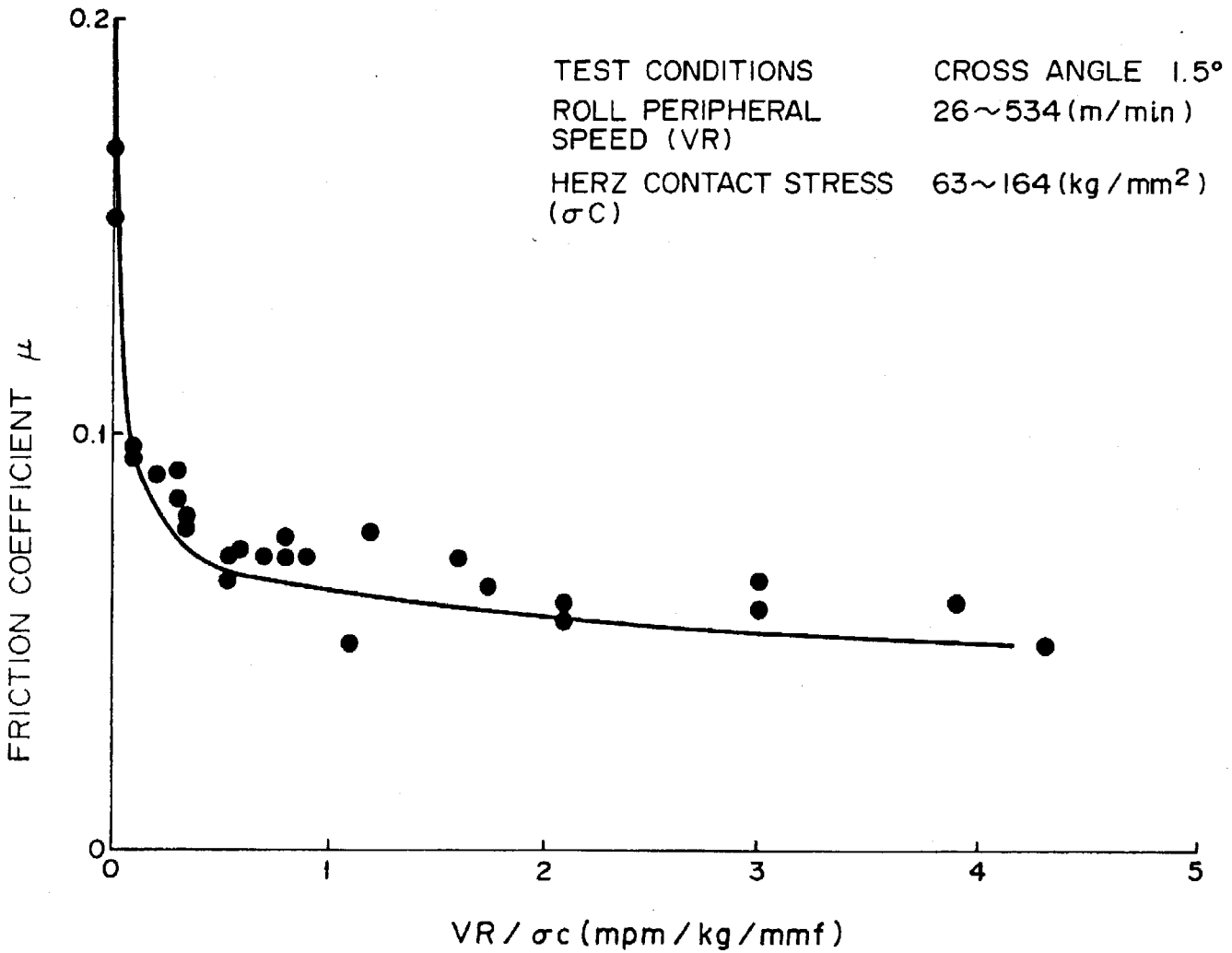
FIG. 2 is a diagram showing correlation between the roll rotation speed and the coefficient of friction in Hertz contact region.
Figure 3:
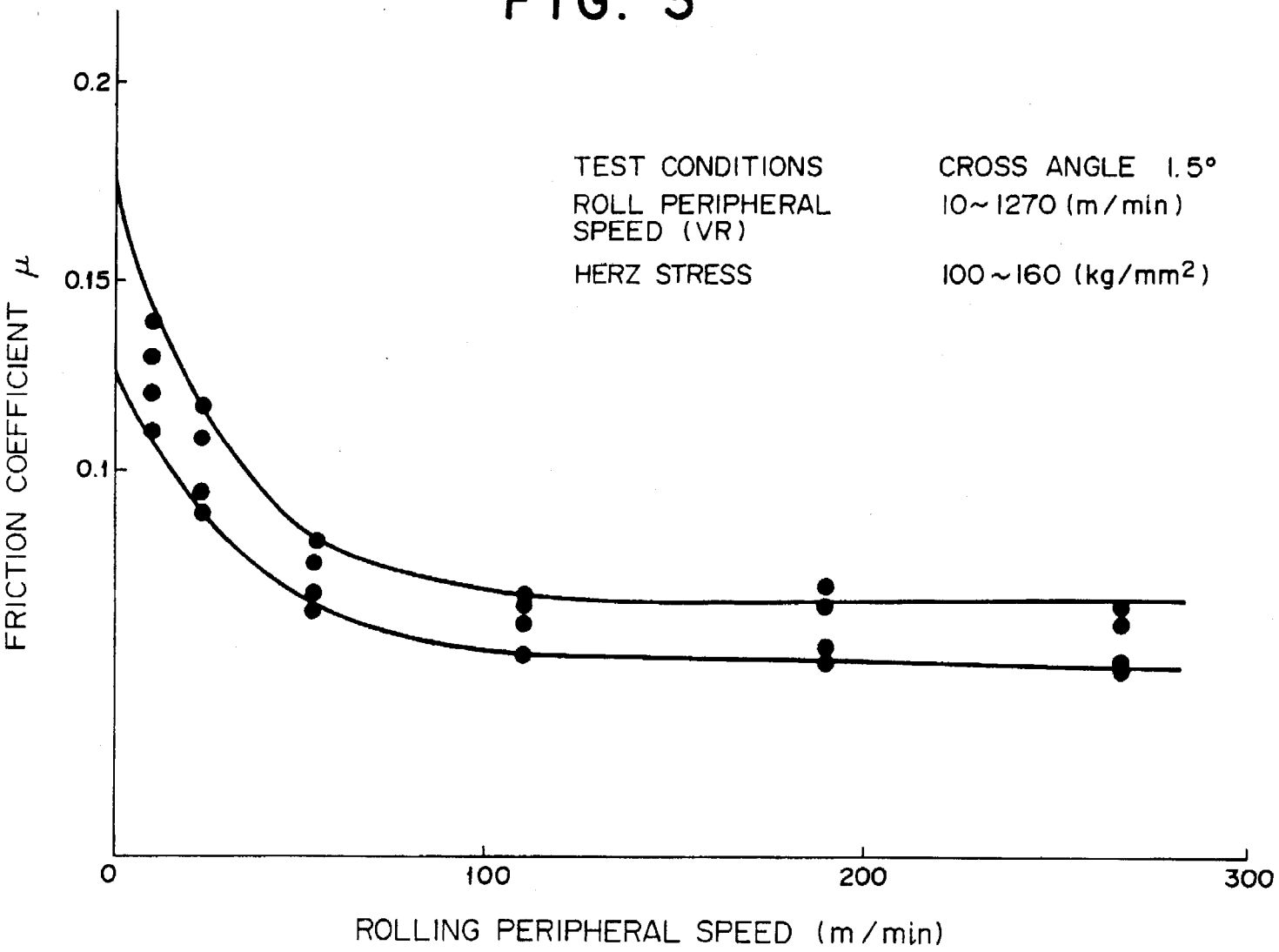
FIG. 3 is a diagram showing the correlation between the roll rotation speed and the friction of coefficient.
Figure 4:
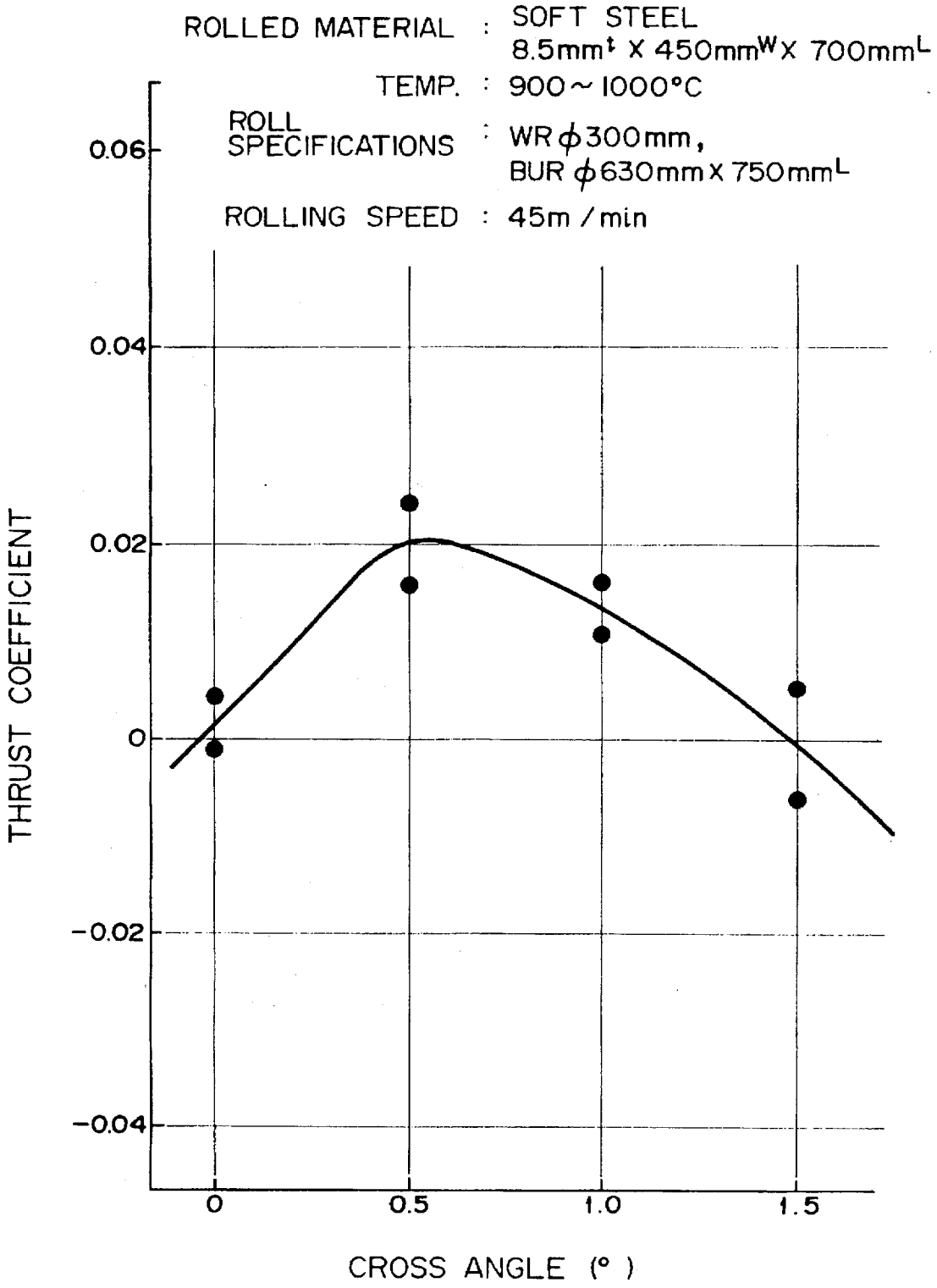
FIG. 4 is an illustration of the results of an experiment illustrative of the relationship between the cross angle and work roll thrust coefficient.
Figure 5:
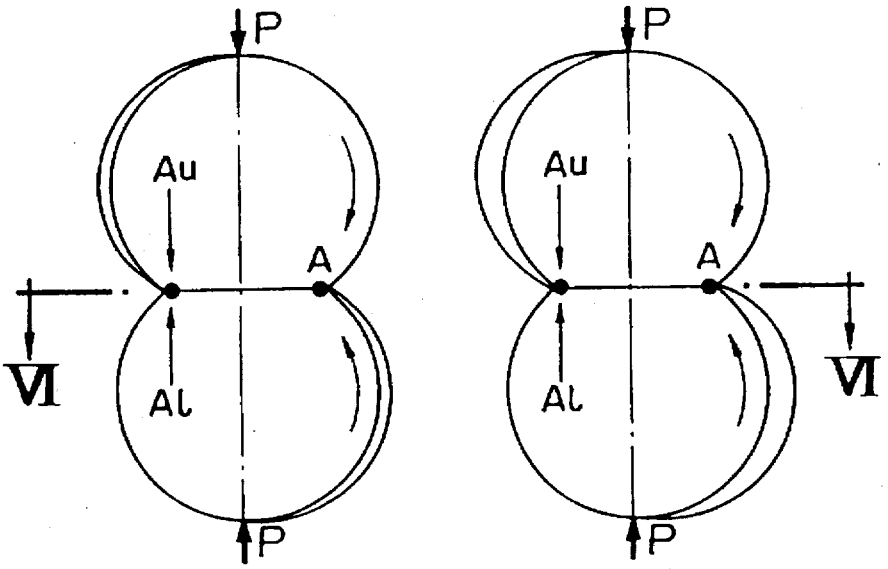
FIG. 5 is an illustration of a Hertz contact region formed in the roll contact region.
Figure 6:
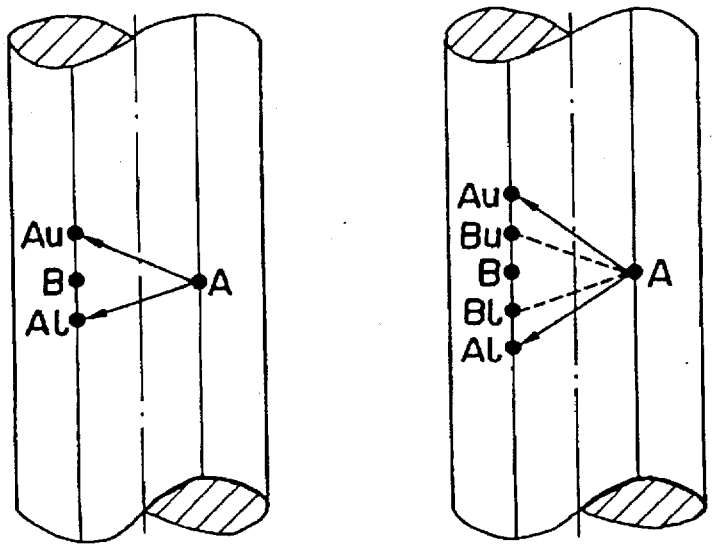
FIG. 6 is an illustration of rolls as viewed in the direction of arrows A—A in FIG. 5.
Figure 7:
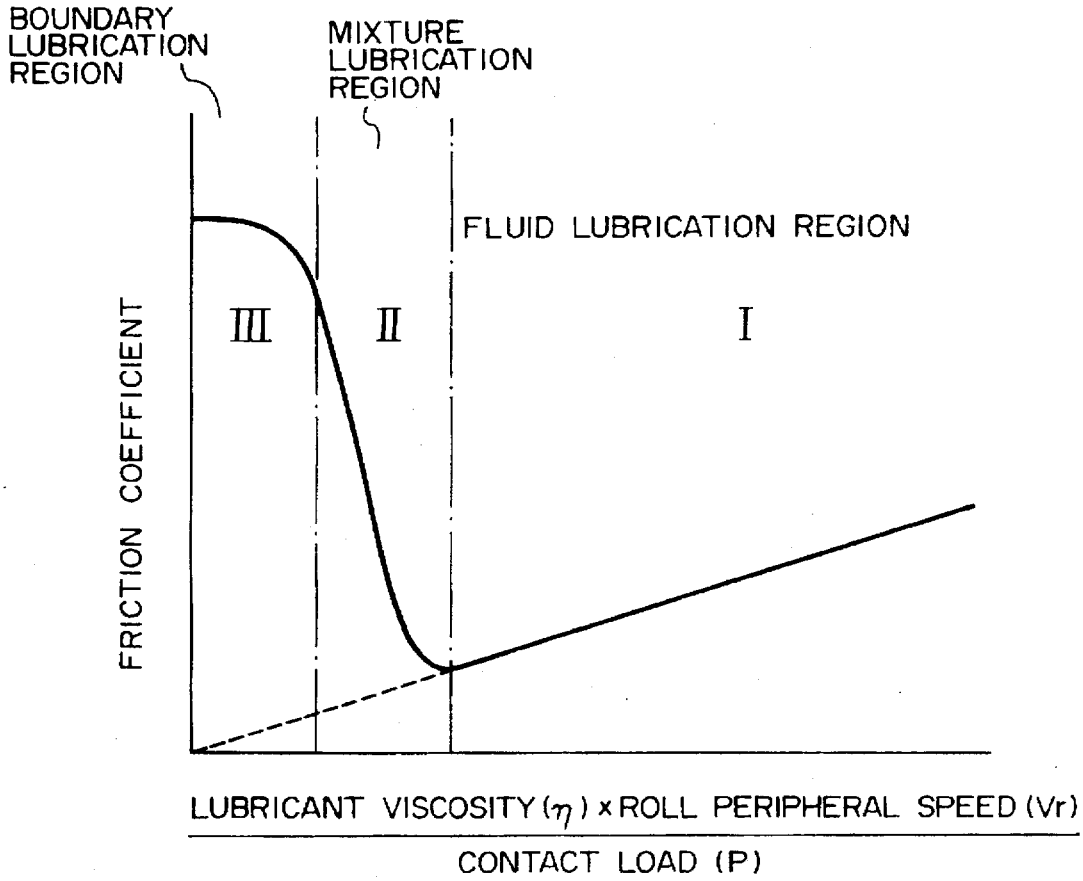
FIG. 7 is a diagram illustrative of the relationships between the contact load P, viscosity $\eta$ of the lubricant and the roll peripheral speed Vr.

The stroke of each hydraulic cylinder is mechanically limited so as not to exceed this maximum stroke. The signals from the sensors 17 which measures the displacements of the hydraulic rams of the hydraulic jacks 13, 14 are fed back to the work roll cross angle controller 18 so that an interlock is realized so as to limit the maximum cross angle to a value ranging from 2.5° to 3.0°, thereby preventing any excessive thrust from being applied to the work rolls. At the same time, the hydraulic pressure in the hydraulic cylinders 33, 34 for holding the work roll thrust plate 32 shown in FIG. 14 are measured to determine the level of the thrust and, when any excessive thrust acting on the work roll is detected, a control is conducted to reduce the thrust through adjustment of the cross angle in accordance with the relationship between the cross angle and the thrust as shown in FIG. 4.

In operation, the upper and lower work rolls are pressed against the cooperating back-up rolls by hydraulic cylinders provided in the project blocks 12 as shown in FIG. 13, thus applying a roll balancing force. Alternatively, the hydraulic cylinders are so controlled to apply a roll bending force in order to control the crowning of the sheet or the profile of the sheet cross-section.

Such a roll balance force or the roll bending force is maintained to be 50 tons/chock or greater so as to strongly press the work rolls 2, 3 against the cooperating back-up rolls 4, 5 thereby preventing the back-up rolls 4, 5 from slipping on the associated work rolls 2, 3, In particular, when the present invention is applied to hot rolling, reduction in the rolling load down to, for example, 300 tons due to clearance of the trailing end of the preceding rolled material is detected by load meters (not shown) which are provided between the back-up roll chocks 8, 9 and the stands 10, and the roll bending force or the roll balance force is adjusted to be 50 tons/chock or greater until the rolls are decelerated to the speed for receiving the subsequent material to be rolled, whereby slipping of the rolls and, hence, damaging of the roll surfaces are prevented to improve the rate of operation of the rolling mill.

Figure 17:
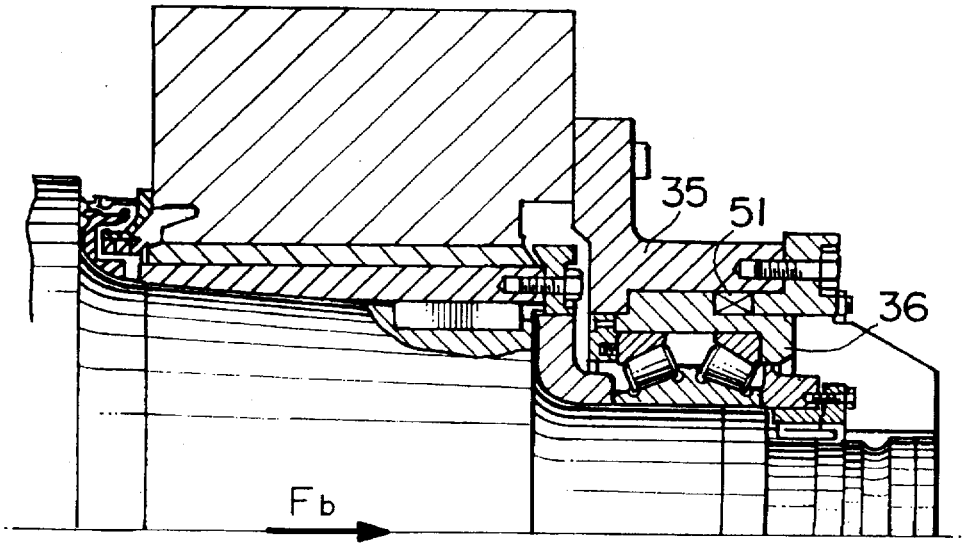
FIG. 17 is a schematic illustration of a structure including a back-up roll bearing in the 4-high mill shown in FIG. 13.

FIG. 17 shows one of the structures including back-up roll bearings employed in the 4-high mill embodying the present invention. A load cell 51 is provided between a thrust bearing 35 disposed on one end of the back-up roll and the associated chock 36 so as to measure the thrust load applied to the back-up roll in the direction $F_b$.

Based on the level of the thrust load thus measured, the rolling load difference which is caused by the crossing of the rolls and which is to be compensated for is determined in accordance with the following equation (16) which is the same as the equation (14) which was explained before.

$$\Delta P = \frac{2}{L_H}\left\{\frac{D_b}{2} + D_w - \mu_{kb}L_{kb}\right\}F_b + \frac{2}{L_H}\left\{-\frac{D_w}{2} - \mu_{kw}L_{kw}\right\}F_w \quad (16)$$

Figure 18:
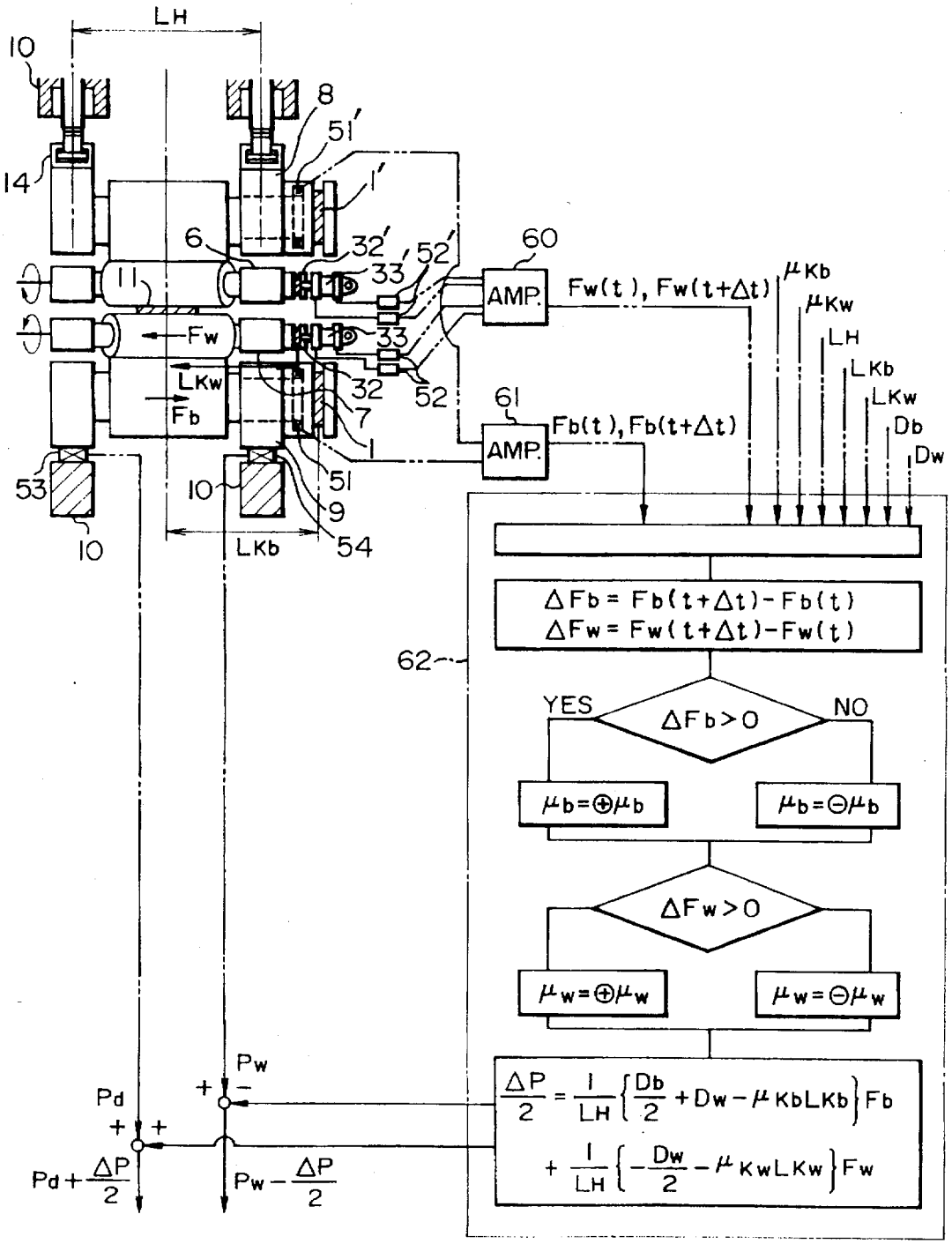
FIG. 18 is a schematic diagram of a compensation circuit for the difference in the rolling load due to thrust force on the back-up roll and the work roll.

FIG. 18 schematically illustrates a diagram of a compensation circuit. As will be seen in this drawing, the upper and lower back-up roll chocks 8 and 9 are connected to a housing 10 via thrust plates 1 and 1' to bear against the thrust forces acting on the rolls. The magnitudes of the thrust forces are measured by load cells 51 and 51' disposed in the back-up rolls. The results of the measurements are fed through an amplifier 61 to a load difference compensation controller 62. The upper and lower work roll chocks are connected to the housing 10 via work roll thrust plates 32 and 32' to bear against the thrust forces acting on the work rolls. The thrust forces on the work rolls are measured by pressure cells 52 and 52' in terms of pressures in cylinders 33 and 33'. The results of the measurements are fed through an amplifier 60 to the load difference compensation controller 62.

On the other hand, values of the following items are also fed into the load difference compensation controller 62:

Work roll diameter $D_w$;

Back-up roll diameter $D_b$;

Distance $L_{kw}$ from the rolling mill center to the work roll thrust plate;

Distance $L_H$ from the rolling mill center to the back-up roll thrust plate;

Distance $L_{kb}$ between the back-up roll chocks of the operation side and driving side;

Coefficient of friction $\mu_{kw}$ between the work roll chock and the work roll thrust plate; and Coefficient of friction $\mu_{kb}$ between the back-up roll chock and the back-up roll thrust plate Based on the work roll thrust forces $F_w(t)$ and $F_w(t+\Delta t)$ and the back-up roll thrust forces $F_b(t)$ and $F_b(t+\Delta t)$ measured at time points t and $(t+\Delta t)$, the load difference compensation controller 62 operates to determine increase or decrease in the thrust forces $F_w$ and $F_b$ during the lapse of time period $\Delta t$. The directions in which the $\mu_{kb}$ and $\mu_{kw}$ operate are specified in the load difference compensation controller 62. The load difference compensation controller then utilizes the equation (16) to calculate the difference in rolling force between the operation side of the rolling mill and the driving side thereof. Basically, the operation is carried out on the basis of the thrust force acting on one of the upper and lower rolls on which load cells for measuring the rolling loads are provided. The results of the calculation are utilized to compensate for output signals from load cells 53 and 54 provided in the lower part of the rolling mill for measuring the rolling loads. More specifically, the rolling loads measured by the load cells 53 and 54 are respectively adjusted by $(\pm\Delta P/2)$. The thus adjusted rolling loads are treated as rolling loads on the operation side and the driving side and displayed on an operation desk as respective rolling loads or a load difference. Thus, the component of the load difference caused due to the crossing of the rolls is eliminated so that a value similar in meaning to the conventional load difference is displayed. Based on the thus displayed value, the operator adjusts the level so as to avoid the occurrence of winding or wedge of strip.

A description will now be given of the method of the invention for using a rolling mill.

Figure 8:
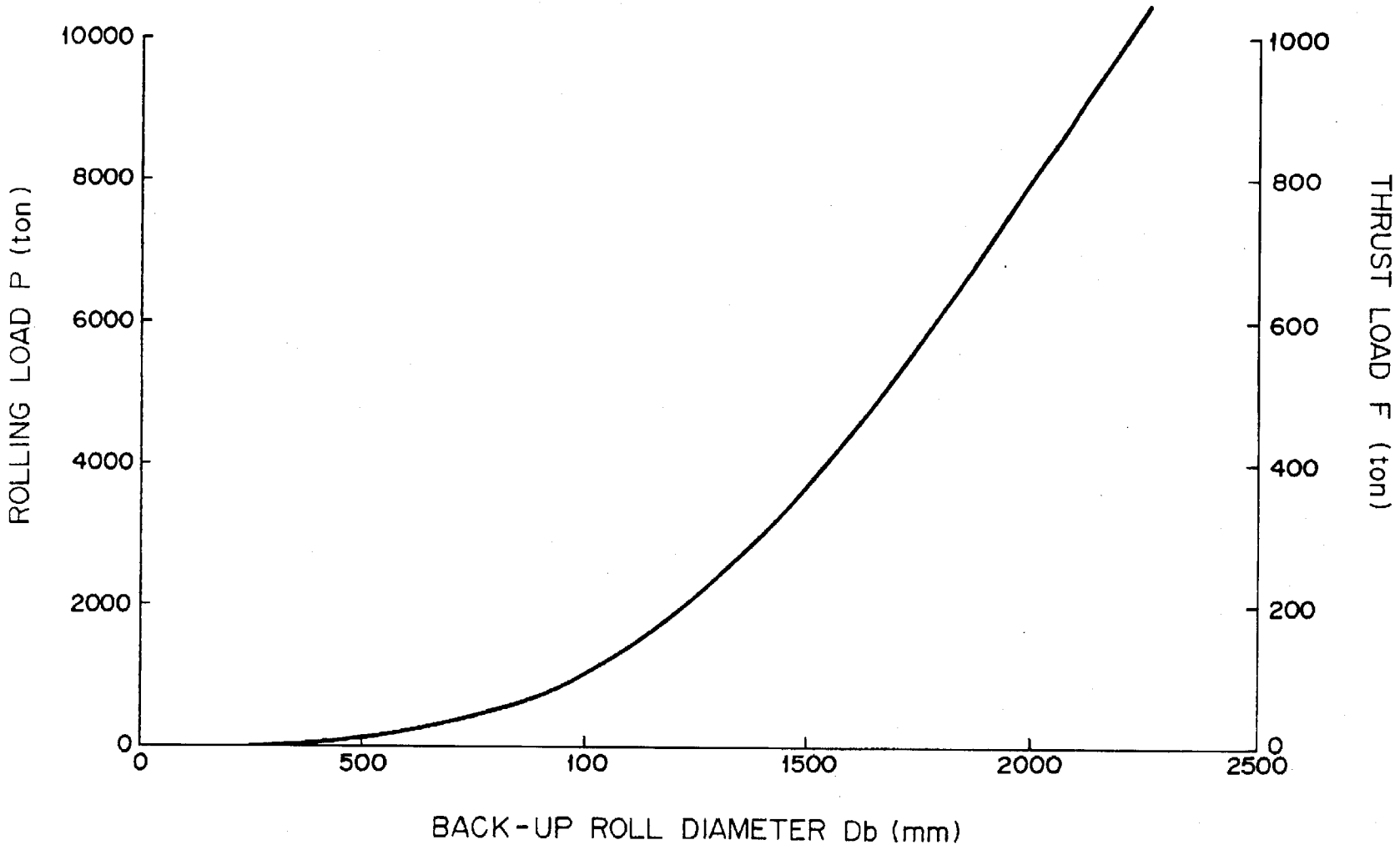
FIG. 8 is a diagram showing the relationship between the back-up roll diameter and the rolling load.
Figure 9:
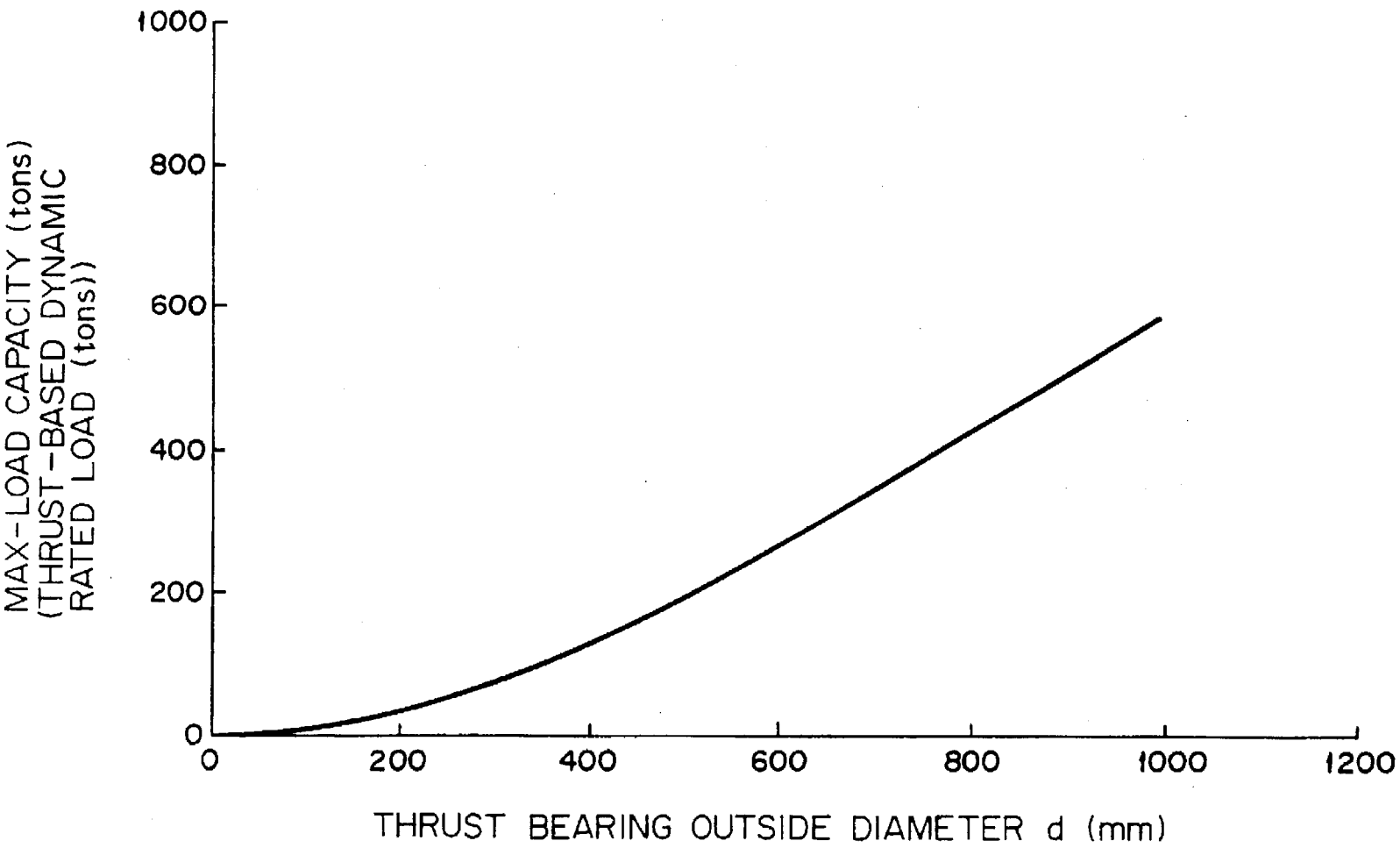
FIG. 9 is a diagram showing the relationship between outside diameter of a thrust bearing and the maximum load capacity (thrust-based dynamic rated load)
Figure 10:
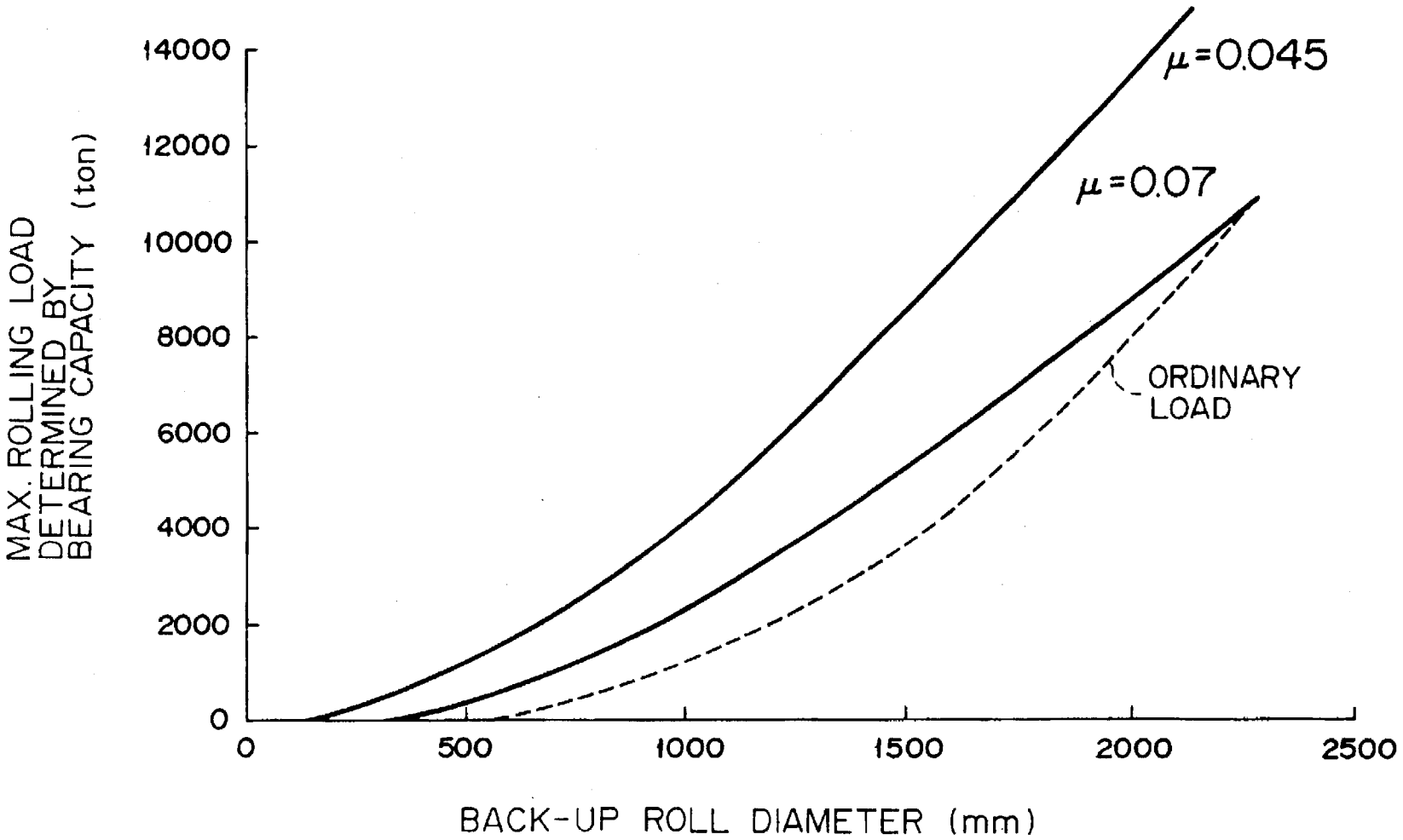
FIG. 10 is a diagram showing the relationship between the outside diameter of the back-up roll and the maximum rolling load which is determined by the bearing capacity.
Figure 11:
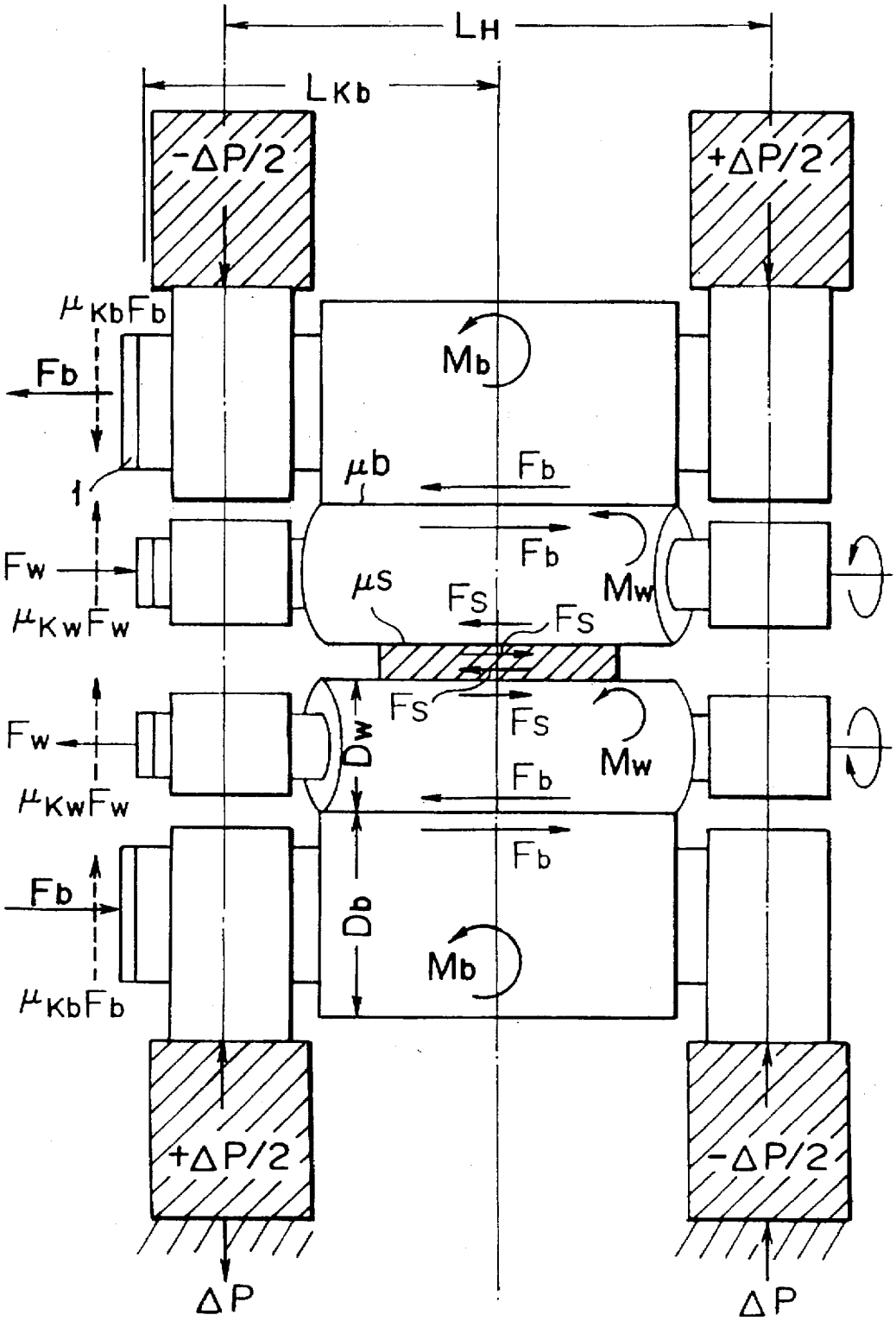
FIG. 11 is a schematic illustration of a rolling mill showing balance of forces during rolling.
Figure 12:
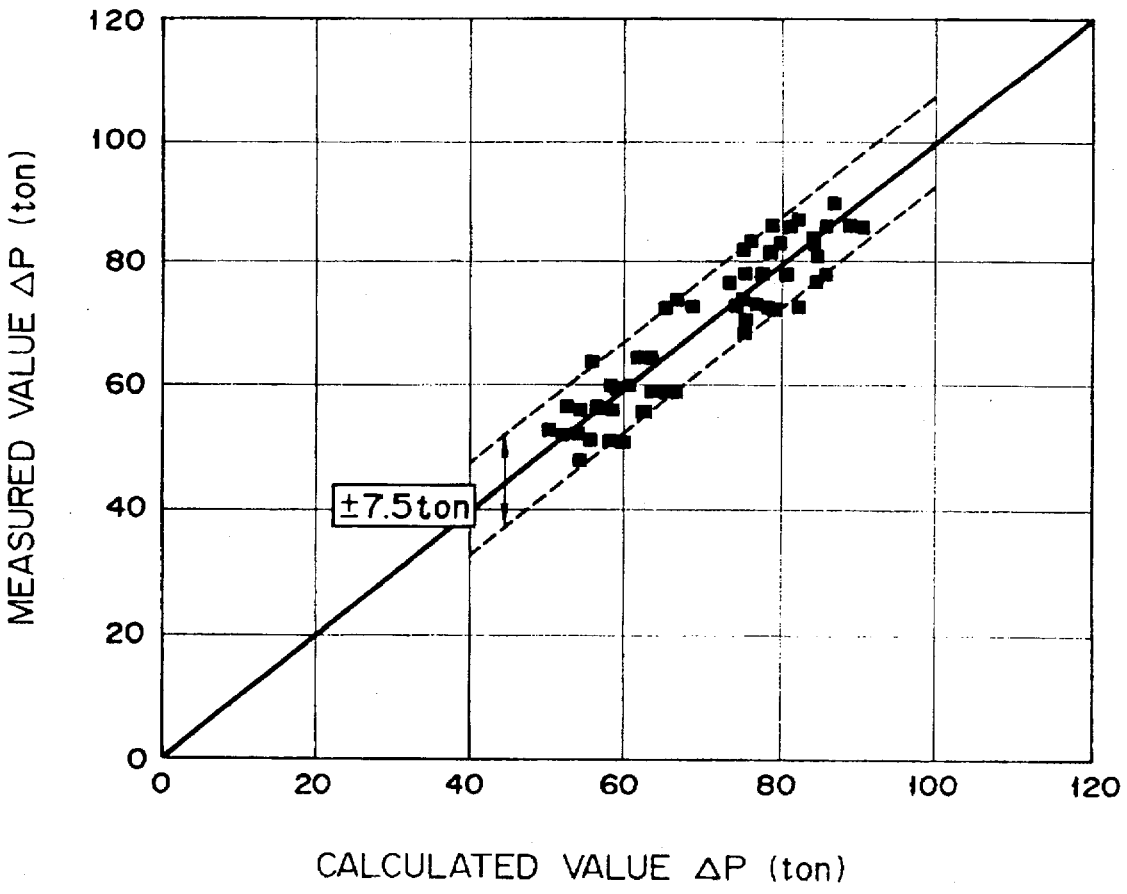
FIG. 12 is a graph showing the result of a comparison between test data and the result of calculation of the rolling load difference.

As shown in FIG. 8, the ability to withstand the thrust is determined by the load capacity of the thrust bearing which is provided on each end of the back-up roll. As stated before, the outside diameter of the thrust bearing is limited to be about ½ the roll diameter at the greatest due to its structure. Namely, the dimensions of the roll chock incorporating the thrust bearing is limited by the back-up roll diameter, so that the load capacity of the thrust bearing is limited by the back-up roll diameter. Thus, the range of use of work-roll crossing rolling mill is limited by the capacity of the thrust bearing which in turn is limited by the roll diameter. The relationship between the back-up roll diameter and the allowable maximum rolling load is roughly summarized in Table 1 below, assuming that the thrust coefficient between the back-up roll and the work roll falls within the range of from 0.045 to 0.07 realized in ordinary rolling mills of the kind described.

TABLE 1

| Back-up roll diameter (mm) | Maximum rolling load (tons) |
|---|---|
| 1200–1400 | 3500 |
| 1400–1600 | 6000 |
| –2200 | 10000 |

From a more strict point of view, the allowable maximum rolling load has to be determined taking into account the construction of the rolling mill, but the values shown above can be used as a general criterion.

Using the data concerning the relationship between the back-up roll diameter and the maximum allowable rolling load as shown in table 1, the levels of maximum rolling load applicable to different types of rolling mills are summarized as shown in Table 2 below.

TABLE 2

| Type of rolling operation | Maximum rolling load (tons) |
|---|---|
| Cold rolling mill | 3500 |
| Hot rough rolling mill | 6000 |
| Hot finish rolling mill | 5000 |
| Thick sheet rolling mill | 10000 |

By selecting and using a work-roll cross mill based on the criterion shown above, it is possible to fully enjoy the performance of the rolling mill without any trouble. Preferably but not exclusively, load meters are provided between the back-up rolls and the housing, and signals from such load meters are feedback to the work roll cross angle controller 15 of the cross roll driving system so that, in the event that the aforesaid maximum allowable rolling load is exceeded, the cross angle is reduced to zero while an alarm is activated. Such a control prevents any excessive thrust from being applied to the back-up rolls, thus contributing to safety in the operation of the rolling mill.

What is claimed is:

1. A rolling mill comprising:

a pair of work rolls;

a pair of back-up rolls for backing up said work rolls, said back-up rolls being so arranged that their axes can be inclined within horizontal planes only to three or four specific angular positions;

means for allowing said work rolls to be inclined within horizontal planes with respect to said back-up rolls such that the axes of said work rolls cross the axes of the associated back-up rolls and cross each other;

means for providing lubrication between each said work roll and the associated back-up roll so as to reduce axial thrust generated therebetween due to the crossing of the rolls; and cross angle setting and controlling means for performing setting and control of the cross angle between said work rolls during rolling operation only when the roll peripheral speed or the rolling speed is above a predetermined minimum value.

2. A rolling mill according to claim 1, wherein said predetermined minimum value is 50 m/min.

3. A rolling mill according to claim 1, further comprising interlocking means which prevents said cross angle setting and controlling means from performing the setting and control of said cross angle between said work rolls when the roll peripheral speed or the rolling speed is below said predetermined minimum value.

4. A rolling mill according to claim 3, wherein said predetermined minimum value is 50 m/min.

5. A rolling mill according to claim 1, wherein said cross angle setting and controlling means sets and controls the angles of said axes of said work rolls in counter directions to each other with respect to a line which is perpendicular to the direction of rolling, within a range of from 0° to 2.5° in accordance with the rolling conditions.

6. A rolling mill according to claim 1, further comprising a work roll thrust plate associated with each said work roll so as to bear a thrust acting on said work roll, a hydraulic cylinder for supporting said work roll thrust plate, and work roll cross angle adjusting means which adjusts the cross angle between said work rolls so as to reduce the thrust when the level of the thrust supported by said hydraulic cylinder has become excessively large.

7. A rolling mill according to claim 1, wherein a work roll bending force or a work roll balance force of 50 tons/chock or greater is applied to said work rolls.

8. A rolling mill according to claim 1, further comprising thrust measuring means for measuring the level of the thrust acting on said back-up roll and said work roll due to crossing of said back-up and work rolls, and rolling load difference compensating means for compensating, based on the thrust level measured by said thrust measuring means, for influence of the roll crossing on the difference in the rolling load appearing between the driving end and the operation end of said rolls.

9. A rolling method for rolling a material by a rolling mill of the type which includes: a pair of work rolls; a pair of back-up rolls for backing up said work rolls, said back-up rolls being so arranged that their axes can be inclined within horizontal planes only to three or four specific angular positions; means for allowing said work rolls to be inclined within horizontal planes with respect to said back-up rolls such that the axes of said work rolls cross the axes of the associated back-up rolls and cross each other; and means for providing lubrication between each said work roll and the associated back-up roll so as to reduce axial thrust generated therebetween due to the crossing of the rolls; said method comprising:

conducting setting and control of the cross angle between said work rolls during rolling operation only when the roll peripheral speed or the rolling speed is above a predetermined minimum value.

10. A rolling method according to claim 9, wherein said predetermined minimum value is 50 m/min.

11. A rolling method according to claim 9, wherein the setting and control of said cross angle between said work rolls is prohibited when the roll peripheral speed or the rolling speed is below said predetermined minimum value.

12. A rolling method according to claim 11, wherein said predetermined minimum value is 50 m/min.

13. A rolling method according to claim 9, wherein the setting and control of the angles of said axes of said work rolls are performed in counter directions to each other with respect to a line which is perpendicular to the direction of rolling, within a range of from 0° to 2.5° in accordance with the rolling conditions.

14. A rolling method according to claim 9, wherein said rolling mill further includes a work roll thrust plate associated with each said work roll so as to bear a thrust acting on said work roll, a hydraulic cylinder for supporting said work roll thrust plate, said method further comprising adjusting the cross angle between said work rolls so as to reduce the thrust when the level of the thrust supported by said hydraulic cylinder has become excessively large.

15. A rolling method according to claim 9, wherein a work roll bending force or a work roll balance force of 50 tons/chock is applied to said work rolls in the period between the clearance of the work rolls by the trailing end of a preceding rolled material and catching of the leading end of the next material to be rolled, thereby preventing slip between said work roll and the associated back-up roll due to deceleration of the rolls.

16. A rolling method according to claim 9, further comprising measuring the level of the thrust acting on said back-up roll and said work roll due to crossing of said back-up and work rolls, and effecting, based on the measured thrust level, compensation for influence of the roll crossing on the difference in the rolling load appearing between the driving end and the operation end of said rolls.

17. A method of using a rolling mill of the type which includes: a pair of work rolls; a pair of back-up rolls for backing up said work rolls, said back-up rolls being so arranged that their axes can be inclined within horizontal planes only to three or four specific angular positions; means for allowing said work rolls to be inclined within horizontal planes with respect to said back-up rolls such that the axes of said work rolls cross the axes of the associated back-up rolls and cross each other; and means for providing lubrication between each said work roll and the associated back-up roll so as to reduce axial thrust generated therebetween due to the crossing of the rolls; said method comprising: using said rolling mill as a rough rolling mill while setting the maximum allowable rolling load to 6000 tons, and setting a cross angle between said work rolls above zero when said rolling load is lower than or equal to said maximum allowable rolling load and setting the cross angle between said work rolls to zero when said maximum allowable rolling load is exceeded.

18. A method of using a rolling mill of the type which includes: a pair of work rolls; a pair of back-up rolls for backing up said work rolls, said back-up rolls being so arranged that their axes can be inclined within horizontal planes only to three or four specific angular positions; means for allowing said work rolls to be inclined within horizontal planes with respect to said back-up rolls such that the axes of said work rolls cross the axes of the associated back-up rolls and cross each other; and means for providing lubrication between each said work roll and the associated back-up roll so as to reduce axial thrust generated therebetween due to the crossing of the rolls; said method comprising: using said rolling mill as a finish rolling mill while setting the maximum allowable rolling load to 5000 tons, and setting a cross angle between said work rolls above zero when said rolling load is lower than or equal to said maximum allowable rolling load and setting the cross angle between said work rolls to zero when said maximum allowable rolling load is exceeded.

19. A method of using a rolling mill of the type which includes: a pair of work rolls; a pair of back-up rolls for backing up said work rolls, said back-up rolls being so arranged that their axes can be inclined within horizontal planes only to three or four specific angular positions; means for allowing said work rolls to be inclined within horizontal planes with respect to said back-up rolls such that the axes of said work rolls cross the axes of the associated back-up rolls and cross each other; and means for providing lubrication between each said work roll and the associated back-up roll so as to reduce axial thrust generated therebetween due to the crossing of the rolls; said method comprising: using said rolling mill as a thick-sheet rolling mill while setting the maximum allowable rolling load to 10000 tons, and setting a cross angle between said work rolls above zero when said rolling load is lower than or equal to said maximum allowable rolling load and setting the cross angle between said work rolls to zero when said maximum allowable rolling load is exceeded.

20. A method of using a rolling mill of the type which includes: a pair of work rolls; a pair of back-up rolls for backing up said work rolls, said back-up rolls being so arranged that their axes can be inclined within horizontal planes only to three or four specific angular positions; means for allowing said work rolls to be inclined within horizontal planes with respect to said back-up rolls such that the axes of said work rolls cross the axes of the associated back-up rolls and cross each other; and means for providing lubrication between each said work roll and the associated back-up roll so as to reduce axial thrust generated therebetween due to the crossing of the rolls; said method comprising: using said rolling mill as a cold rolling mill while setting the maximum allowable rolling load to 3500 tons, and setting a cross angle between said work rolls above zero when said rolling load is lower than or equal to said maximum allowable rolling load and setting the cross angle between said work rolls to zero when said maximum allowable rolling load is exceeded.

* * * * *